US007635295B2

(12) United States Patent
Enomoto et al.

(10) Patent No.: US 7,635,295 B2
(45) Date of Patent: Dec. 22, 2009

(54) COIN REPLENISHING APPARATUS FOR A COIN RECEIVING AND DISPENSING MACHINE

(75) Inventors: Minoru Enomoto, Iwatsuki (JP); Masayoshi Umeda, Iwatsuki (JP)

(73) Assignee: Ashai Seiko Kabushiki Kaisha, Tokyo (JP)

( * ) Notice: Subject to any disclaimer, the term of this patent is extended or adjusted under 35 U.S.C. 154(b) by 101 days.

(21) Appl. No.: 11/960,000

(22) Filed: Dec. 19, 2007

(65) Prior Publication Data

US 2008/0171508 A1 Jul. 17, 2008

(30) Foreign Application Priority Data

Dec. 19, 2006 (JP) ..... 2006-341659

(51) Int. Cl.
*G07D 1/00* (2006.01)

(52) U.S. Cl. ..... 453/18

(58) Field of Classification Search ..... 453/18, 453/63; 194/344, 350
See application file for complete search history.

(56) References Cited

U.S. PATENT DOCUMENTS 3,246,932 A * 4/1966 White, Jr. ..... 406/151
3,455,503 A * 7/1969 Coffield ..... 232/1 R
3,538,641 A * 11/1970 Miller ..... 49/192
4,545,475 A * 10/1985 Fillod et al. ..... 194/350
5,082,101 A * 1/1992 Baker et al. ..... 194/350
5,533,605 A * 7/1996 Mays et al. ..... 194/206
5,899,804 A * 5/1999 Chiba et al. ..... 453/11
6,719,121 B2 * 4/2004 Alexander et al. ..... 194/350

FOREIGN PATENT DOCUMENTS

JP 2001-101476 4/2001

* cited by examiner

*Primary Examiner*—Patrick Mackey
*Assistant Examiner*—Mark Beauchaine

(57) ABSTRACT

A coin replenishing apparatus, such as a detachable safe, can be securely mounted on a coin receiving and dispensing machine. The safe can have an interior cavity with an opening that can be covered by a lid that is lockable. Coins can be deposited into the safe cavity in a bulk state. A shutter member is movable from an exterior of the safe body member to enable the opening and closing of access to the interior cavity. The safe body exterior can have guide rails, connectors and other features for both securing and determining the position of the safe above a coin receipt opening in the coin receiving and dispensing apparatus.

11 Claims, 24 Drawing Sheets

(A)

(B)

COIN REPLENISHING APPARATUS FOR A COIN RECEIVING AND DISPENSING MACHINE

BACKGROUND OF THE INVENTION

1. Field of the Invention

The present invention relates to a coin replenishing apparatus for a coin receiving and dispensing machine. Specifically, the present invention relates to a coin replenishing safe for a coin receiving and dispensing machine that prevents a worker from having unauthorized access to coins in a compact coin receiving and dispensing machine.

2. Description of Related Art

As a conventional technique, in a coin receiving and dispensing machine, after sorting coins are input a retaining portion for each kind of coin, and are dispensed in a predetermined number of coins from the retaining portion to a coin dispensing port based upon a coin dispensing command. A cassette apparatus when mounted on the coin receiving and dispensing machine so as to cover a coin input port, is automatically locked on the coin receiving and dispensing machine, wherein a coin dropping shutter automatically puts an outlet opening facing the coin input port into an opening state, and when being removed from the coin receiving and dispensing machine, the coin dropping shutter automatically closes a coin dispensing opening.

When a replenishing cassette of the cassette apparatus is mounted on the coin receiving and dispensing machine, change coins are automatically replenished to the coin receiving and dispensing machine as shown in Japanese Patent No. 3581806 (FIG. 2, FIG. 4 and FIG. 5, Page 3).

In the conventional apparatus, since the coin dropping shutter is opened and closed in a laterally-sliding manner, the design must be made in consideration of a sliding range of the shutter, which results in a problem of an increase in size of the apparatus. When a travel amount of the shutter is reduced in order to solve the problem, the outlet opening must be made smaller.

On the other hand, when the height of the coin receiving and dispensing machine is reduced, it is necessary to reduce a height from an upper face of a belt for conveying coins to an upper end of the coin input port. In a coin receiving and dispensing machine with a low height, when a predetermined number of coins are collectively input, it is necessary to expand the width of the belt (a direction orthogonal to an advancing direction of the belt) in order to prevent a coin from flying out from the coin input port.

A coin receiving and dispensing machine, serving as a change machine disposed below a register, is required to be smaller in size, and especially to be low in height. When the above measures are combined in order to make smaller the height of a downsized coin receiving and dispensing machine, the width of the outlet opening of the cassette apparatus becomes smaller than that of the coin input port. In other words, a dead space can be formed between a lower face of the cassette and the belt.

When such a dead space occurs, there is a possibility that all of the coins cannot be replenished completely because a coin input from the cassette may enter in the dead space to be fitted therein in a standing state, so that a system of reducing the travel amount of the shutter cannot be readily adopted.

Thus a secure manner and apparatus to replenish coins or token in an economical manner is still a goal of this industry.

SUMMARY OF THE INVENTION

A first object of the present invention is to provide a coin replenishing apparatus capable of replenishing all types of coins even when being used in a coin receiving and dispensing machine with a low height.

A second object of the present invention is to provide a downsized coin replenishing apparatus that prevents a worker from removing coins in a coin replenishing safe and can be used in a coin receiving and dispensing machine with a low height.

A third object of the present invention is to inexpensively provide a coin replenishing apparatus which can be used in a coin receiving and dispensing machine with a low height.

In order to achieve the above objects, a coin replenishing apparatus system of a coin receiving and dispensing machine according to the present invention is configured in the following manner.

The present invention is a coin replenishing apparatus for a coin receiving and dispensing machine, which is a coin replenishing safe attached to a coin input port of a coin receiving and dispensing machine which, after conveying coins input by a conveying member disposed below the coin input port, sorts the coins and retains the coins in a retaining apparatus separately according to kinds of the coins, and dispenses a predetermined number of coins based upon a dispensing command from the retaining apparatus corresponding to the kinds of the coins.

The coin replenishing safe includes a safe chamber, a replenishing door with a locking apparatus capable of opening and closing an outlet opening positioned on the downside of the safe chamber and a replenishing hole of the safe chamber, a shutter mounted in the coin replenishing safe, capable of rotating about a transverse axis, and capable of closing the outlet opening, a shutter locking unit for the shutter, rotating unit for the shutter, and unlocking unit for the shutter locking unit, and the coin receiving and dispensing machine includes an attachment apparatus for attaching the coin replenishing safe on the coin receiving and dispensing machine in a state of placing the outlet opening on the coin input port and main body locking unit for locking the coin replenishing safe on the coin receiving and dispensing machine.

The coin replenishing apparatus for the coin receiving and dispensing machine includes a stopper for blocking the shutter from rotating in a direction opposite to an opening direction of the outlet opening at a time of rotating in the opening direction of the outlet opening.

The coin replenishing apparatus further includes an operation handle joined to the shutter via drive joining unit and exposed outside the coin replenishing safe.

The coin replenishing apparatus can include a torque limiter disposed in the drive joining unit between the shutter and the operating handle.

A coin replenishing safe of a coin receiving and dispensing machine which, after conveying coins on a belt disposed below the coin input port, sorts the coins and retains the coins in a retaining apparatus separately according to the kinds of the coins, and dispenses a predetermined number of coins based upon a dispensing command from the retaining apparatus corresponding to the kinds of the coins. The coin replenishing safe includes a safe chamber, a replenishing door with a locking apparatus capable of opening and closing an outlet opening positioned on the downside of the safe chamber and a replenishing hole of the safe chamber; a lateral circular coin retaining portion formed in the coin replenishing apparatus; a replenishing port opened at an upper end portion of the coin retaining portion; a replenishing lid locked to the coin replenishing safe by a locking means to cover the replenishing port; an outlet opening opened at a lower end portion of the coin retaining portion; a shutter mounted in the coin retaining portion, capable of rotating about a transverse axis, and capable of closing the outlet opening; shutter locking means for the shutter; rotating means for the shutter; and unlocking means for the shutter locking means, and the coin receiving and dispensing machine includes an attaching means for attaching the coin replenishing safe on the coin receiving and dispensing machine in a state of placing the outlet opening on the coin input port and main body locking means for attaching the coin replenishing safe on the coin receiving and dispensing machine.

In this configuration, when the coin replenishing safe is mounted on the coin receiving and dispensing machine, the coin replenishing safe is fixed on the coin receiving and dispensing machine by the main body locking means in a state of placing the outlet opening on the coin input port.

At this time, since the outlet opening has approximately the same shape as the coin input port, no dead space is configured between the coin replenishing safe and the conveying member in the coin input port.

In order to supply the replenishment coins to the coin input port, the shutter closing the outlet opening is moved. Thereby, the shutter is removed from the outlet opening, and the coins drop onto the conveying member through the coin input port from the outlet opening.

The shutter opens the outlet opening according to its rotational movement rotating around a retaining chamber for coins. The shutter moves upward without projecting outside the coin replenishing apparatus, and opens the outlet opening.

Therefore, since the outlet opening can be enlarged corresponding to the coin input port, no dead space is formed between the outlet opening and the conveying member for coin conveyance, so that there is an advantage that all coins can be replenished.

Besides, even if the outlet opening is enlarged corresponding to the coin input port, the shutter does not projects beyond the coin replenishing safe, so that there is an advantage that the coin replenishing safe can be downsized.

When the outlet opening is opened by rotating the shutter, the shutter can substantially rotate only in the opening direction due to the stopper. Therefore, since the outlet opening cannot be closed by returning the shutter during replenishing the replenishment coins to the coin input port, the coins in the retaining chamber are exhausted.

An operation handle is joined to the shutter via the drive joining unit and is exposed outside the coin replenishing safe. By rotating the operation handle, the shutter can be manually rotated to open the outlet opening. Therefore, since the shutter is manually operated, a drive motor or the like is not used, so that the coin replenishing apparatus can be inexpensively configured and downsized.

A torque limiter is interposed in the drive joining unit between the shutter and the operating handle. Thereby, when torque equal to or more than a predetermined value is applied to the operation handle, the shutter does not rotate, and the operation handle rotates idly, so that a drive transmission mechanism of the shutter is not broken.

When coins are replenished in the coin replenishing safe, the replenishing lid is opened by unlocking the locking unit to expose a replenishing port opened at an upper end portion of the coin retaining portion, and the replenishment coins are input to the retaining chamber from the replenishing port. At this time, since the outlet opening at the lower end portion of the coin retaining portion is closed by the shutter, and the shutter is fixed by the shutter locking unit, the coins are retained in bulk in the coin retaining portion. After the replenishment coins are inserted, the replenishing lid is closed, and fixed on the coin replenishing safe by the locking unit. Thereby, all openings of the coin retaining portion of the coin replenishing safe are closed by a lid and the like having the locking unit, so that a worker cannot take out and input coins freely.

When replenishment coins are replenished in the coin receiving and dispensing machine, the coin replenishing safe is mounted in a state of placing an outlet opening of the coin replenishing safe on the coin input port. The coin replenishing safe is fixed by the main body locking unit when it is mounted on the coin receiving and dispensing machine.

Next, after the shutter locking unit for the shutter is unlocked, the outlet opening is opened by rotating the operation handle. Due to the opening, the coins in the retaining chamber are dropped by gravity, and dropped onto a conveying belt via the coin input port. The replenishment coins dropped are conveyed to the next step by the conveying belt, and are sorted for each kind of the coins and retained.

By returning the shutter to a closing position for the outlet opening, the main body locking unit can be unlocked, so that the coin replenishing safe can be detached from the coin receiving and dispensing machine.

The present invention is a coin replenishing apparatus for a coin receiving and dispensing machine which is a coin replenishing safe which includes a safe chamber, a replenishing door with a locking apparatus capable of opening and closing an outlet opening positioned on the downside of the safe chamber and a replenishing hole of the safe chamber. lateral circular coin retaining portion is formed in the coin replenishing apparatus, and a replenishing port opens at an upper end portion of the coin retaining portion. A replenishing lid is locked by a locking unit on the coin replenishing safe to cover the replenishing port. An outlet opening is opened at a lower end portion of the coin retaining portion with a shutter mounted in the coin retaining portion, and capable of rotating about a transverse axis, for closing the outlet opening. A shutter locking unit for the shutter includes a rotating means for the shutter and an unlocking unit for the shutter locking unit. The coin receiving and dispensing machine includes an attaching unit for attaching the coin replenishing safe on the coin receiving and dispensing machine in a state of placing the outlet opening on the coin input port and a main body locking unit for attaching the coin replenishing safe to the coin receiving and dispensing machine

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings.

FIG. 5A is a perspective view thereof, viewed from the upper left front thereof, and FIG. 5B is a perspective view thereof, viewed from the upper right rear thereof;

DETAILED DESCRIPTION OF THE PREFERRED EMBODIMENTS

Reference will now be made in detail to the preferred embodiments of the invention which set forth the best modes contemplated to carry out the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well known methods, procedures, components, and circuits have not been described in detail as not to unnecessarily obscure aspects of the present invention.

The coin replenishing apparatus is a safe that can be secured by an authorized person such as a manager and workers can mount the locked safe on a coin receiving and dispensing machine without requiring access to the stored coins or tokens. A common input port for receiving coins can have the safe secured to the input port and then subsequently the contents of the safe, such as coins or tokens can be released into the coin receiving and dispensing machine.

An exterior handle can be enabled to be operated, either manually or automatically for an interior release of the coin or token into the input port. Sensors can monitor the mounting and release of the safe and activate various locking members to respectively lock and release the safe. The workers will not have access to the coins and will return the empty safes to the manager for replenishing of a subsequent charge of coins or tokens. Note coins are used in the following description but, as known in the coin dispensing industry, tokens, medallions and other items representing monetary equivalents can be used.

The first embodiment is an example in which coins, to be dispensed for change, can be replenished by mounting a replacement coin replenishing safe on a coin receiving and dispensing machine which receives coins of eight kinds, such as 2 Euros, 1 Euro, 50 cents, 20 cents, 10 cents, 5 cents, 2 cents and 1 cent, which are currency of the European Union. The machine retains the coins, after sorting them according to the kinds of the coins, and dispenses a predetermined number of coins of predetermined kinds to a coin dispensing port based upon a dispensing command.

Figure 1:
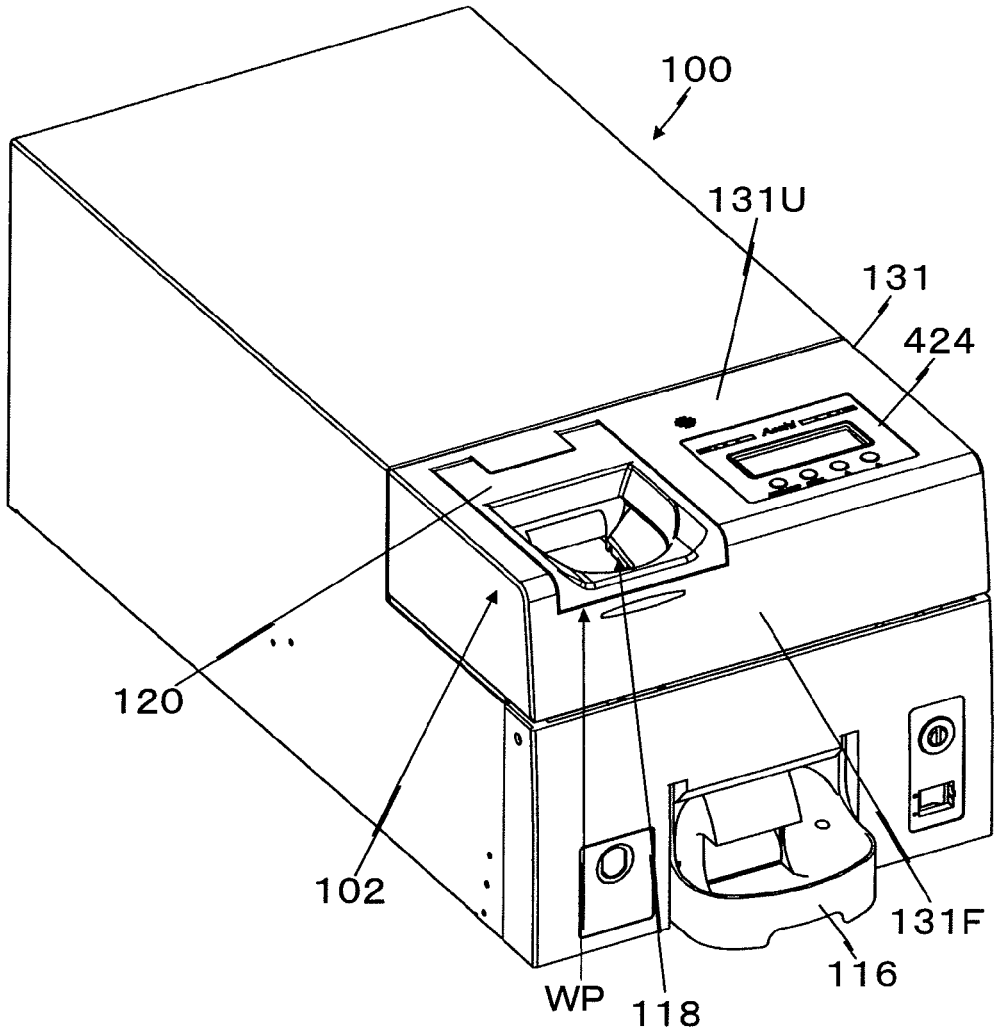
FIG. 1 is a perspective view of a coin receiving and dispensing machine for configuring a coin replenishing apparatus of a first embodiment of the present invention.
Figure 2:
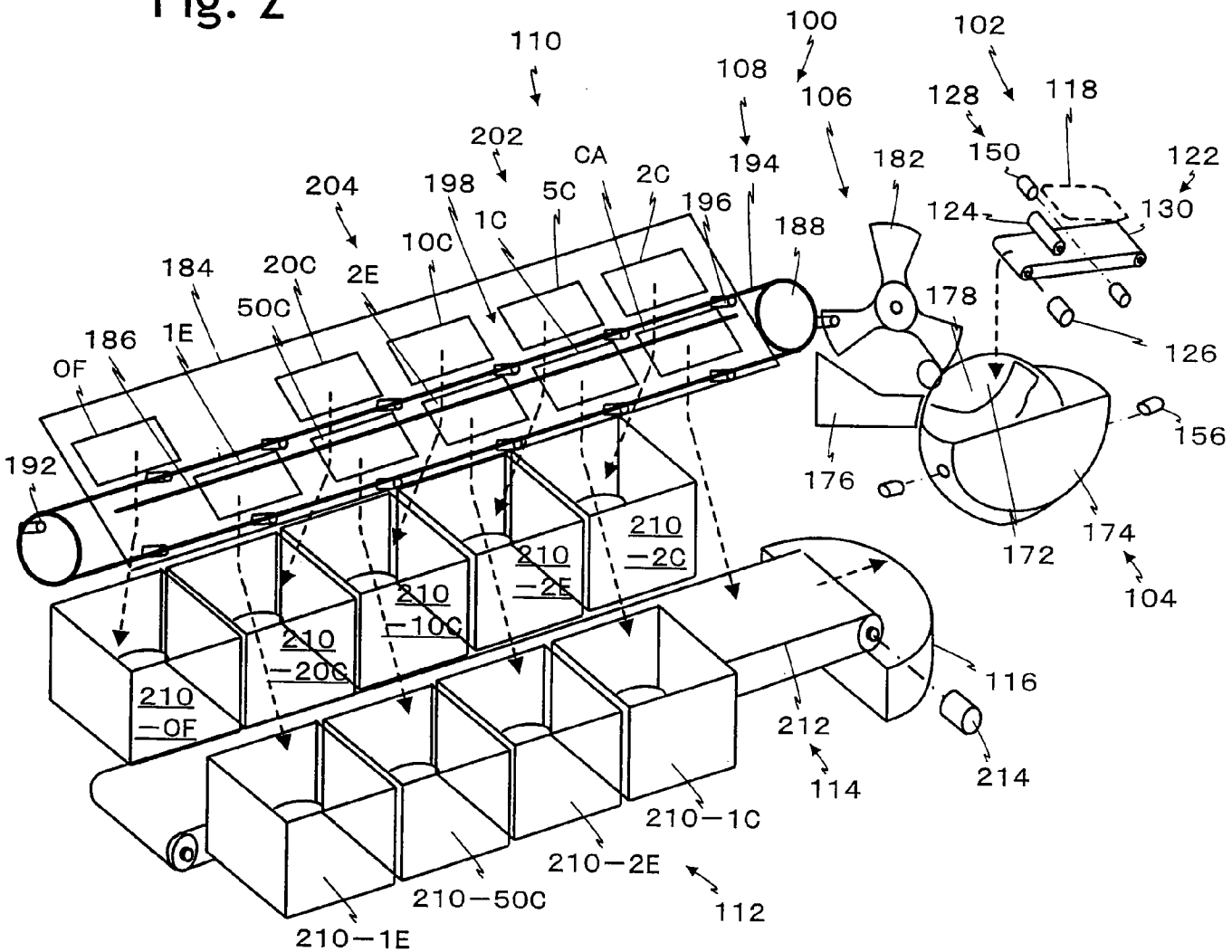
FIG. 2 is a block diagram of the coin receiving and dispensing machine for configuring the coin replenishing apparatus of the first embodiment of the present invention.

First, a brief summary of a coin receiving and dispensing machine 100 will be explained with reference to FIG. 1 and FIG. 2. The coin receiving and dispensing machine 100 includes a coin receiving apparatus 102, a separating and delivering apparatus 104, a coin-kind identifying apparatus 106, a conveying apparatus 108, a sorting apparatus 110, a retaining apparatus 112, a coin dispensing apparatus 114, and a coin dispensing tray 116.

First, the coin receiving apparatus 102 will be explained. The coin receiving apparatus 102 has a function of delivering plural kinds of coins, input bulk into a D-shaped coin input port 118, to the separating and delivering apparatus 104 within a range of a predetermined amount which does not disturb the function of the separating and delivering apparatus 104 in the next step.

The coin receiving apparatus 102 includes a dropping port cover 120, a conveying member 122, an electric motor 126 for driving a reverse roller 124 and the conveying member 122, and a coin sensor 128.

Figure 3:
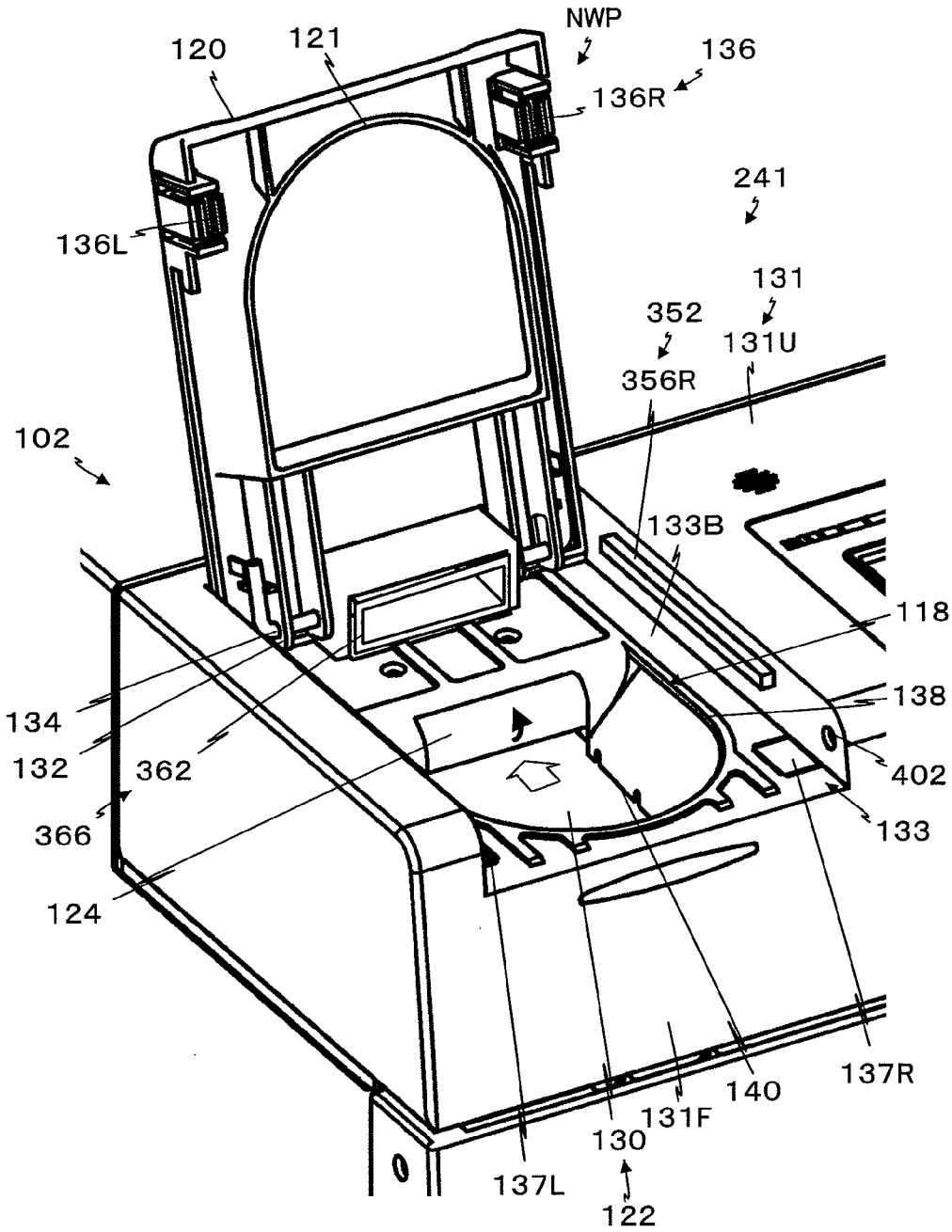
FIG. 3 is an enlarged perspective view of a coin replenishing safe mounting portion of the coin receiving and dispensing machine configuring the coin replenishing apparatus of the first embodiment of the present invention.

The conveying member 122 will be explained with reference to FIG. 2 and FIG. 3. The conveying member 122 has a function of conveying inputted coins toward the next step.

The conveying member 122 can be a flat belt 130 in the first embodiment, which has a width slightly wider than twice the largest diameter of a coin. The flat belt 130 is provided between a pair of rollers and held in a tension state, and is provided to be inclined slightly upward in a downstream coin movement direction. However, a flat belt 130 may also be in a horizontal alignment if necessary.

The flat belt 130 is movable in a delivering direction in which coins are delivered to the next step and in a returning direction which is the opposite direction according to a normal rotation and reverse rotation of the electric motor 126.

Next, the reverse roller 124 will be explained mainly with reference to FIG. 2. The reverse roller 124 has a function of blocking the advance of certain coins conveyed in a stack like manner (overlaid) and causing sliding off of an upper stacked coin when the flat belt 130 advances in the delivering direction. The reverse roller 124 is disposed above a downstream end portion of the flat belt 130 within a regulatory space, which is a little less than about three times the thickness of the thinnest coin and a little larger than the thickness of the thickest coin, between a lower end peripheral face thereof and the flat belt 130.

The reverse roller 124 is configured to rotate with its lower face rotating in a direction opposite to an advancing direction of the flat belt 130 when the flat belt 130 advances in the conveying direction to the next step (in a direction of an arrow in FIG. 3), and to be placed into a stationary state when the flat belt 130 moves in the returning direction.

However, it is also possible when the flat belt 130 moves in the returning direction, for the reverse roller 124 to be rotated so that the lower face of the reverse roller 124 returns in the same direction.

Thereby, such regulating movement between the flat belt 130 and the roller 124 prevents a large amount of coins from being supplied to the separating and delivering apparatus 104 at one time. When three or more of the thinnest coins pile up on the flat belt 130 and reach the reverse roller 124, the top coin is prevented from advancing by the reverse roller 124, and is moved relatively in the returning direction and pushed off the pile of coins.

In order to prevent two or more coins that are piled up from passing through the regulatory space, the size of the regulatory space can be larger than the thickness of the thinnest coin and less than twice the thickness thereof.

Next, the dropping port cover 120 will be explained mainly with reference to FIG. 3.

The dropping port cover 120 has a flat-plate shape, on which a coin dropping guide hole 121 having a D shape extends in a vertical direction and narrowing side portion extends downward at its center. The dropping port cover is supported by a pivot bearing 132 to be capable of pivoting upward with respect to a main body 131 of the coin receiving and dispensing machine 100.

The dropping port cover 120 is disposed on a mounting recessed portion 133 of the main body 131, and it is fixed in an operating position when the dropping port cover 120 is fitted in the mounting recessed portion 133 during operation of the coin receiving and dispensing machine 100 to be made flush with an upper face 131U and a front face 131F of the main body 131.

A pivot shaft 134 attached horizontally to the main body 131 penetrates the pivot bearing 132 slidably in a long hole 135 (see FIG. 17) of the main body 131. Further, a distal end portion of the dropping port cover 120 is fixed on the main body 131 with a fixing unit 136. The fixing unit 136 has a function of keeping the dropping port cover 120 fixed on the main body 131.

The fixing unit 136 comprises permanent magnets 136L and 136R attached on the left and right lower face of the dropping port cover 120, and iron pieces 137L and 137R fixed on a bottom face 133B of the mounting recessed portion 133 of the main body 131 opposite to the permanent magnets 136L and 136R. When the dropping port cover 120 is inserted into the mounting recessed portion 133, the permanent magnets 136L and 136R attract the iron pieces 137L and 137R so that the dropping port cover 120 is fixed by the attracting force of the magnets.

In a case of moving the dropping port cover 120 upward in a pivoting manner, the dropping port cover 120 is slid frontward within the range of the long hole 135 to cause the distal end of the dropping port cover 120 to project slightly from the front face 131F, and the projecting end portion is pushed up, thereby the dropping port cover 120 is moved upward in a pivoting manner.

When the dropping port cover 120 is pivoted upward, an upper face thereof can be leaned on a wall face of the mounting recessed portion 133 and held at a replenishing position SP in an approximately-vertical state. With the port cover 120 raised, a replenishing safe 220 can be operatively mounted, see FIG. 17.

A coin dropping hole 138, see FIG. 3, having the same shape as the coin dropping guide hole 121 and extending in a vertical direction is formed on the bottom face 133B of the mounting recessed portion 133 below the dropping cover 120. The coin dropping hole 138 has a function of holding coins received in bulk on the conveying member 122.

The coin dropping hole 138 has a funnelform cylindrical shape in which a left sidewall 142L, a right sidewall 142R, and a front wall 146 are inclined downward, and a peripheral face of the reverse roller 124 is disposed on a rear wall. An upper end opening of the coin dropping hole 138 is a coin receiving port 118, and a lower end opening thereof is a delivery port 140. When the dropping port cover 120 is positioned at the operating position WP, a lower end opening of the coin dropping guide hole 121 and the coin dropping hole 138 form a continuous integrated dropping hole.

Figure 4:
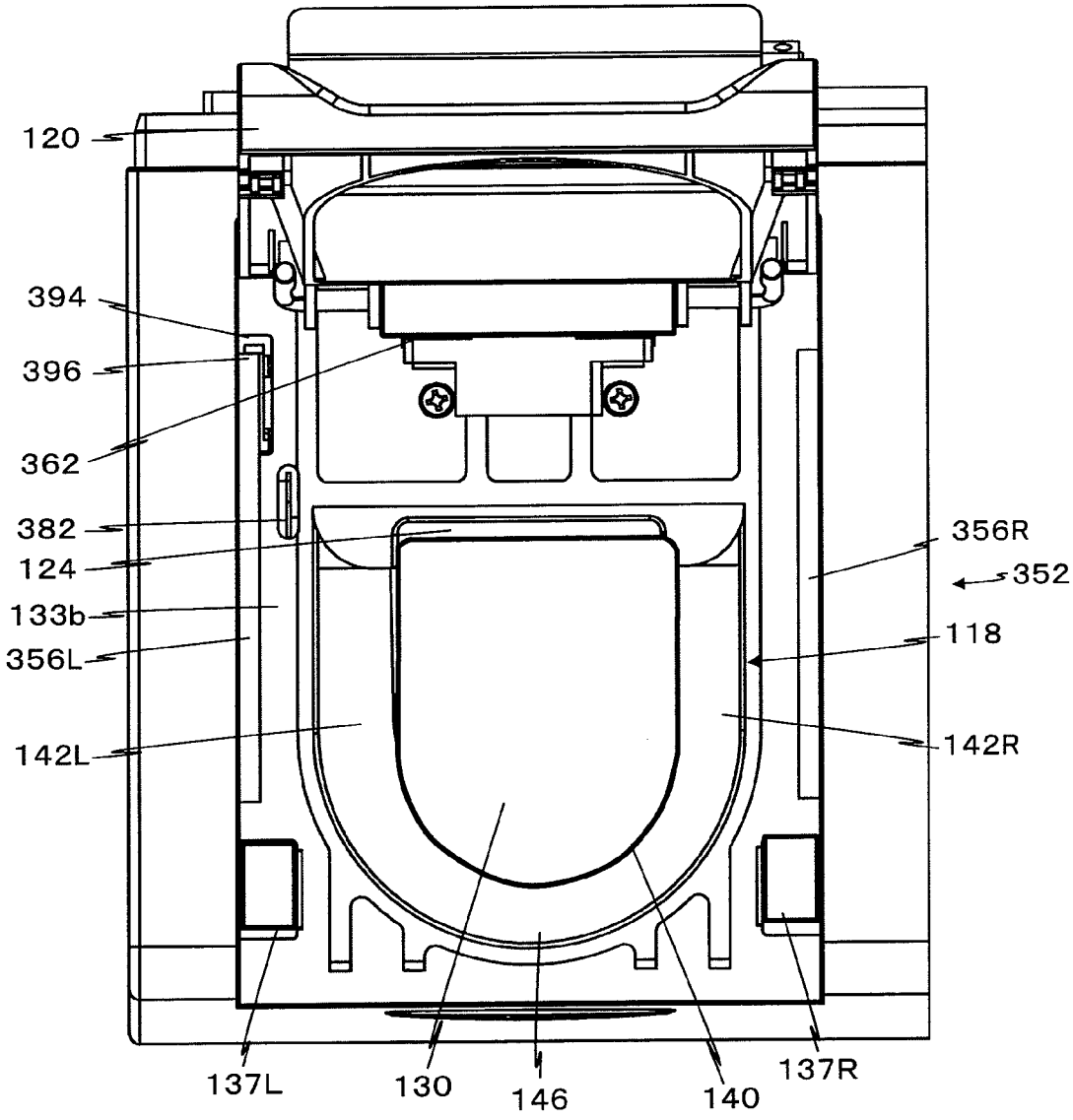
FIG. 4 is an enlarged plan view of the coin replenishing safe mounting portion of the coin receiving and dispensing machine configuring the coin replenishing apparatus of the first embodiment of the present invention.

Next, the delivery port 140 having a U-shaped opening in a plan view will be explained with reference to FIG. 4.

Figure 19:
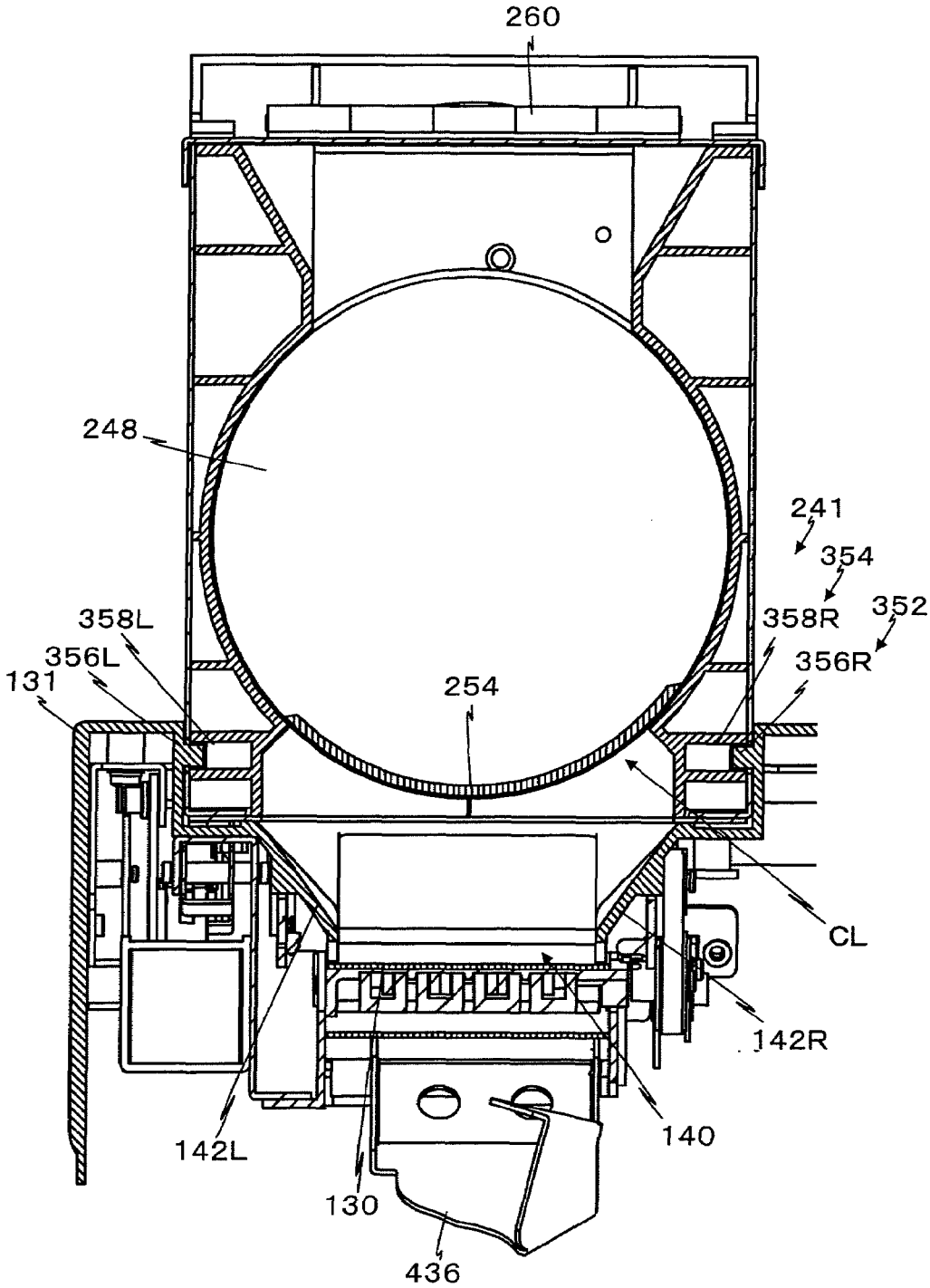
FIG. 19 is a sectional view taken along line F-F in FIG. 18 in the state in which the coin replenishing safe of the first embodiment of the present invention is mounted on the coin receiving and dispensing machine and in a state in which an outlet opening is closed.

The delivery port 140 is disposed above the flat belt 130 with a distance smaller than the thickness of the thinnest coin between the delivery port 140 and the flat belt 130 (see FIG. 19). The reverse roller 124 extends across the open end of the U-shaped opening above the flat belt 130 for releasing coins.

As shown in FIG. 19, the left sidewall 142L and the right sidewall 142R defining the left and right of the delivery port 140 extend in parallel with each other at an interval slightly wider than twice the diameter of the largest coin to be received, and are formed to have slopes inclined downward at an angle of about 50 degrees with respect to the upper face of the flat belt 130. This makes it easier to drop coins held in one's hand into the coin dropping guide hole 121, and a receiving amount of coins is increased, by enlarging the coin receiving port 118.

Further, since a distance between the left sidewall 142L and the right sidewall 142R is set to be slightly larger than twice a coin with the maximum diameter, an advantage is provided in that any coin jam caused by sandwiching coins between the left and right sidewalls is reduced or eliminated and it is easy to take out the coins. It is preferable that the heights of the left sidewall 142L and the right sidewall 142R are as low as possible in order to prevent a coin from standing on the flat belt 130.

Rear end portions of the left sidewall 142L and the right sidewall 142R are connected to each other via the arc-shaped front side wall 146. Thereby, a standing coin which may be leaned on the left sidewall 142L or the right sidewall 142R can be led to a central portion of the flat belt 130 along the front side wall 146 by causing the flat belt 130 to advance in a direction opposite to the delivering direction, thereafter, the standing coin can be laid onto an upper face of the flat belt 130 by causing the flat belt 130 to advance in the delivering direction.

Figure 17:
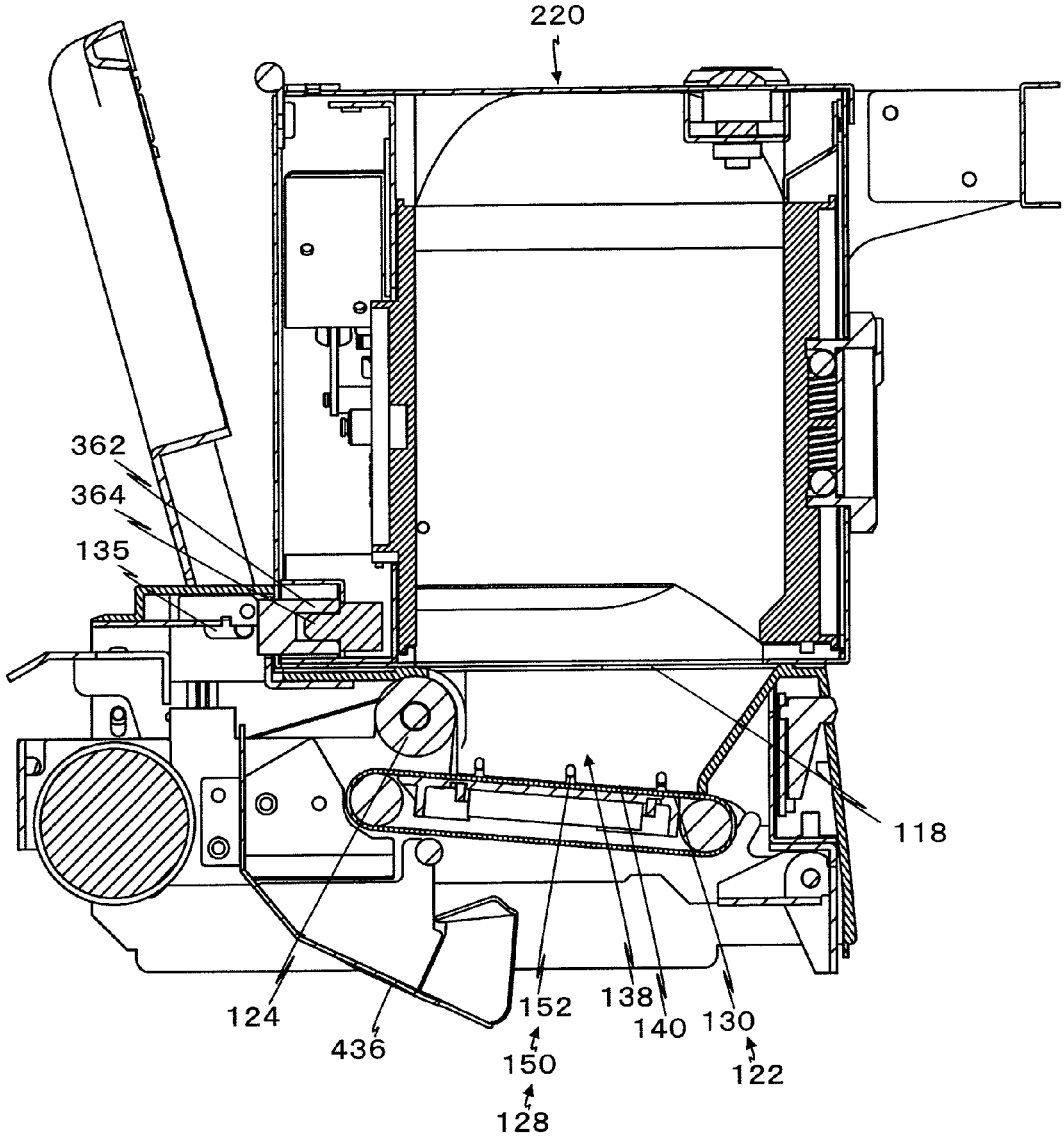
FIG. 17 is a sectional view taken along an E plane in FIG. 16 in the state in which the coin replenishing safe of the first embodiment of the present invention is mounted on the coin receiving and dispensing machine and in a state in which an outlet opening is opened.

Next, the coin sensor 128 will be explained mainly with reference to FIG. 17. The coin sensor 128 has a coin-reception detecting function of detecting a presence of a coin on the conveying member 122. In other words, whether or not all coins put are delivered to the separating and delivering apparatus 104 is indirectly detected.

A plurality of bored holes 152 for receiving respectively a light-projecting member and a light-receiving member of a photo-electronic sensor 150 serving as a coin sensor 128 are formed on opposite faces of the left sidewall 142L and the right sidewall 142R. The coin sensor 128 is configured by disposing the photo-electronic sensor 150 such that an optical axis thereof crosses slightly above the flat belt 130 positioned just above the delivery port 140. When the optical axis of the coin sensor 128 is cut off, coins are considered to be put on the belt 130, and the electric motor 126 is activated to move the flat belt 130 in the delivering direction.

When a full sensor 156 of the separating and delivering apparatus 104, which will be described later, detects a full state, the motor 126 is stopped. Therefore, the separating and delivering apparatus 104 never receives coins of a full amount or more from the coin receiving apparatus 102, and it can separate the coins and deliver them in a one by one manner.

Incidentally, the coin sensor 128 can be replaced with a magnetic sensor placed on the underside of the flat belt 130, or a magnetic sensor and a photo-electronic sensor 150 can be used in combination as a coin sensor 128 as alternative embodiments.

Next, the coin separating and delivering apparatus 104 will be explained with reference to FIG. 2.

The separating and delivering apparatus 104 has a function of separating a plurality of different kinds of coins received in bulk from the coin receiving apparatus 102 in a one by one manner and delivering them to the next processing step. The separating and delivering apparatus 104 is disposed below the coin receiving apparatus 102, and includes a rotating plate 172, a retaining bowl 174, a receiving member 176, and a full sensor 156, as shown in FIG. 2.

First, the rotating plate 172 will be explained. The rotating plate 172 includes a receiving portion 178 for receiving coins one by one, is disposed in an inclined manner at a predetermined angle, and is rotated at a predetermined speed. The receiving portion 178 is set to have a size which cannot receive two coins with the smallest diameter in a state of being side-by-side and can only receive one coin with the largest diameter.

The receiving portion 178 of the rotating plate 172 receives coins from the retaining bowl 174 in bulk, one by one, at its lower portion facing the retaining bowl 174, and delivers the coins to a knife-shaped receiving member 176.

A full state sensor 156 has a function of outputting a full state signal when an amount of coins in the retaining bowl 174 reaches a predetermined amount or greater, and can be a transmissive photo-electronic sensor, for example. Other types of sensors as known in this field can be used. When the full sensor 156 outputs a full signal, the electric motor 126 is stopped, and the supply of coins from the coin receiving apparatus 102 is stopped. When the full sensor 156 ceases an output, it provides a signal, the electric motor 126 is restarted, and coins on the flat belt 130 are supplied to the retaining bowl 174.

Next, a coin-kind identifying apparatus 106 will be explained. The coin-kind identifying apparatus 106 has a function of identifying the authenticity and the kinds of coins delivered one by one, from the separating and delivering apparatus 104. The coin-kind identifying apparatus 106 has a function of identifying the authenticity and kinds of coins based upon detection data obtained from a sensor (not shown) in the course of which the coins are moved by a rotating wiper 182.

Specifically, the coin-kind identifying apparatus 106 has a function of identifying the authenticity and kinds of coins based upon detection data from a coin material sensor, a coin thickness sensor, and a coin diameter sensor. The sensors can be magnetic sensors, for example, as known in this industry.

Next, the conveying apparatus 108 will be explained. The conveying apparatus 108 has a function of conveying coins, where the authenticity and kinds of coins have been identified by the coin-kind identifying apparatus 106, to the sorting apparatus 110. In other words, the conveying apparatus 108 has a function of pushing coins, a face of which is supported by a slide plate which will be described later and a peripheral face of which is supported by a guide rail 186, to move them in a predetermined direction.

The conveying apparatus 108 includes a chain 194 provided in a tensioned state between sprockets 188 and 192 and a pushing pin 196 projecting from the chain 194, where the chain 194 works in conjunction with the rotating wiper 182. Therefore, coins delivered one by one by the rotating wiper 182 are pushed by the pushing pin 196 and moved on the guide rail 186 and an upper face of the slide plate 184, and thereby conveyed linearly along a moving path 198.

Next, the sorting apparatus 110 will be explained.

The sorting apparatus 110 has a function of sorting coins moved by the conveying apparatus 108 according to the kinds of coins. The sorting apparatus 110 includes a first sorting unit 202 disposed on the upside of traveling path 198 along the moving path 198 and a second sorting unit 204 disposed on the downside of the moving path 198 along the guide rail 186.

The first sorting unit 202 comprises a sorting hole for 2 cents 2C, a sorting hole for 5 cents 5C, a sorting hole for 10 cents 10C, a sorting hole for 20 cents 20C, and a sorting hole for overflow OF, starting from the upstream side. The second sorting unit 204 comprises a sorting hole for cancel CA, a sorting hole for 1 cent 1C, a sorting hole for 2 euros 2E, a sorting hole for 50 cents 50C, and a sorting hole for 1 Euro 1E, starting from the upstream. A coin conveyed by the conveying apparatus 108 drops due to its own weight into a corresponding sorting hole when a gate disposed on each sorting hole opens based upon the kind of the coin identified by the coin-kind identifying apparatus 106.

Next, the retaining apparatus 112 will be explained. The retaining apparatus 112 has a function of separately retaining coins sorted according to the kinds of the coins in the sorting apparatus 110. In the first embodiment, the retaining apparatus 112 is configured by arranging coin hoppers 210 for dispensing coins one by one by a rotating disk (not shown) in two rows facing the first sorting unit 202 and the second sorting unit 204 below the sorting apparatus 110 according to the kinds of the coins. The respective coin hoppers are denoted by reference numeral 210 appended with symbols according to the kinds of the coins.

The respective sorting holes 2C, 5C, 10C, 20C, OF, CA, 1C, 2E, 50C, and 1E and the respective coin hoppers 210-2C, 210-5C, 210-10C, 210-20C, 210-OF, 210-CA, 210-1C, 210-2E, 210-50C, and 210-1E are communicated with each other via a chute (not shown), respectively.

Next, the coin dispensing apparatus 114 will be explained. The coin dispensing apparatus 114 has a function of conveying coins dispensed from the coin hoppers 210 according to the kinds of the coins to the coin dispensing tray 116. In the first embodiment, the coin dispensing apparatus 114 is a flat belt 212 disposed between two coin hopper rows. The flat belt 212 is selectively driven by an electric motor 214 such that its upper face moves toward the coin dispensing tray 116. Coins conveyed by the flat belt 212 are supplied to the coin dispensing tray 116. The coin dispensing tray 116 has a function of retaining the coins delivered by the flat belt 212, and has a bowl shape.

Next, a coin replenishing safe 220 according to the present invention will be explained with reference to FIG. 5 to FIG. 11.

The coin replenishing safe 220 of the first embodiment is capable of permitting an opening an outlet opening of a safe chamber after an upper replenishing door of the safe chamber is locked, only on the predetermined condition that the coin replenishing safe 220 is locked into the coin receiving and dispensing machine 100. The coin replenishing safe 220 includes a replenishing safe main body member 222, a replenishing door 224, a replenishing door locking apparatus 226, a shutter 228, shutter locking unit 232, shutter opening unit 236, shutter unlocking unit 238, and a safe casing 240.

Figure 10:
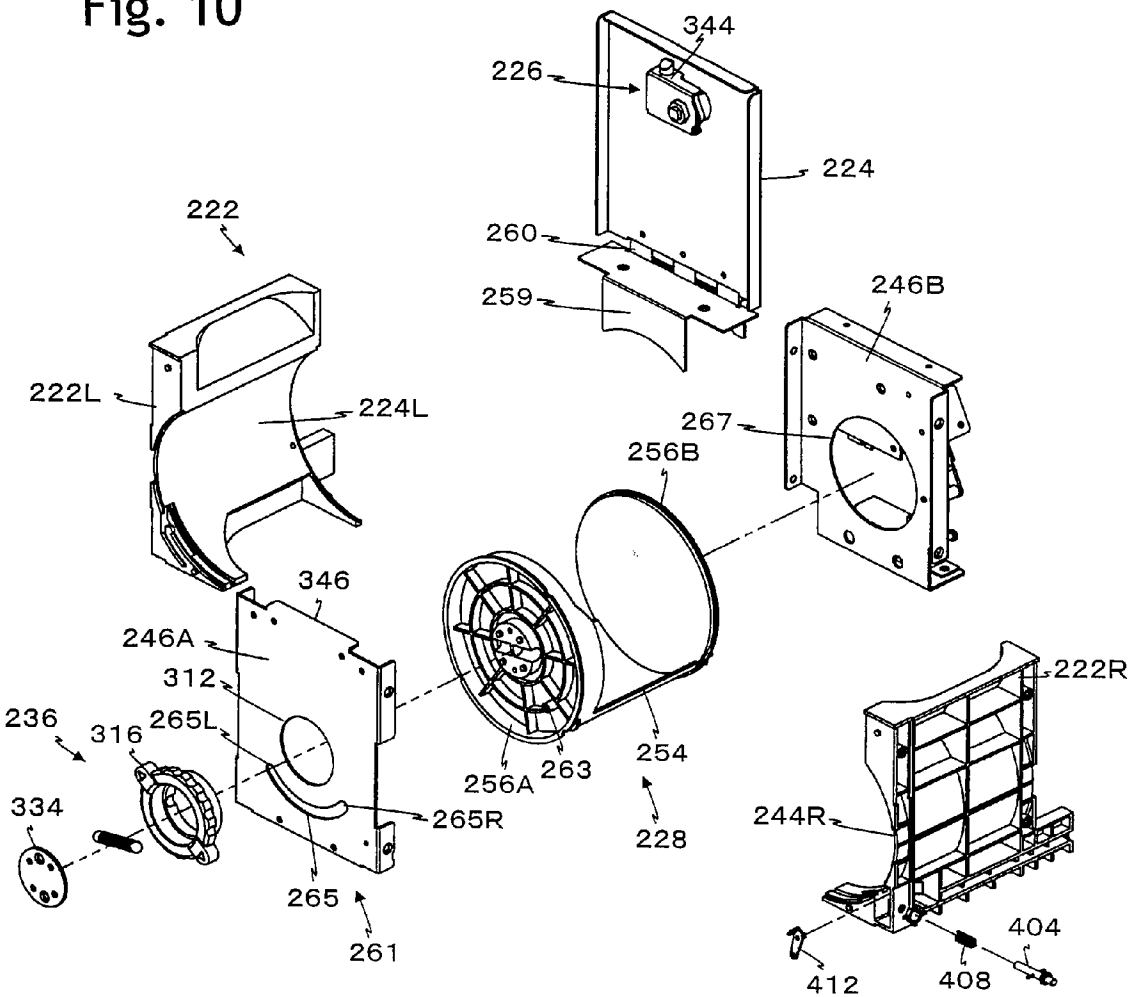
FIG. 10 is an exploded perspective view of a main body of the coin replenishing safe of the first embodiment of the present invention.

First, the replenishing safe main body 222 will be explained with reference to FIG. 10.

The replenishing safe main body 222 can be longitudinally split in half, with a left divided member 222L including a left arc-shaped sidewall 244L and a right divided member 222R having a right arc-shaped sidewall 244R, which are caused to abut or face each other. Rectangular side plates 246A and 246B are fixed on front and rear end faces of the integrated left and right divided members 222L and 222R, whereby a transversely-cylindrical safe chamber 248 (see FIG. 8) is configured when assembled.

A rectangular vertical replenishing hole 250 (see FIG. 11) is formed on an upper portion of the safe chamber 248, and an approximately-rectangular vertical outlet opening 252 having approximately the same shape as the coin input port 118 is formed on a lower portion thereof.

Next, a shutter 228 will be explained. The shutter 228 has a function of opening and closing the outlet opening 252 selectively. The shutter 228 of the first embodiment is rotatably fitted in the safe chamber 248.

In detail, the shutter 228 includes a curved shutter plate 254 having a curvature similar to the left and right arc-shaped sidewalls 244L and 244R and circular side plates 256A and 256B formed integrally on front and rear end portions of the shutter plate 254. Therefore, the safe chamber 248 is exactly a transversely-cylindrical space enclosed by the right arc-shaped sidewall 224R, the left arc-shaped sidewall 244L, the circular side plates 256A and 256B, and the shutter plate 254.

Figure 7:
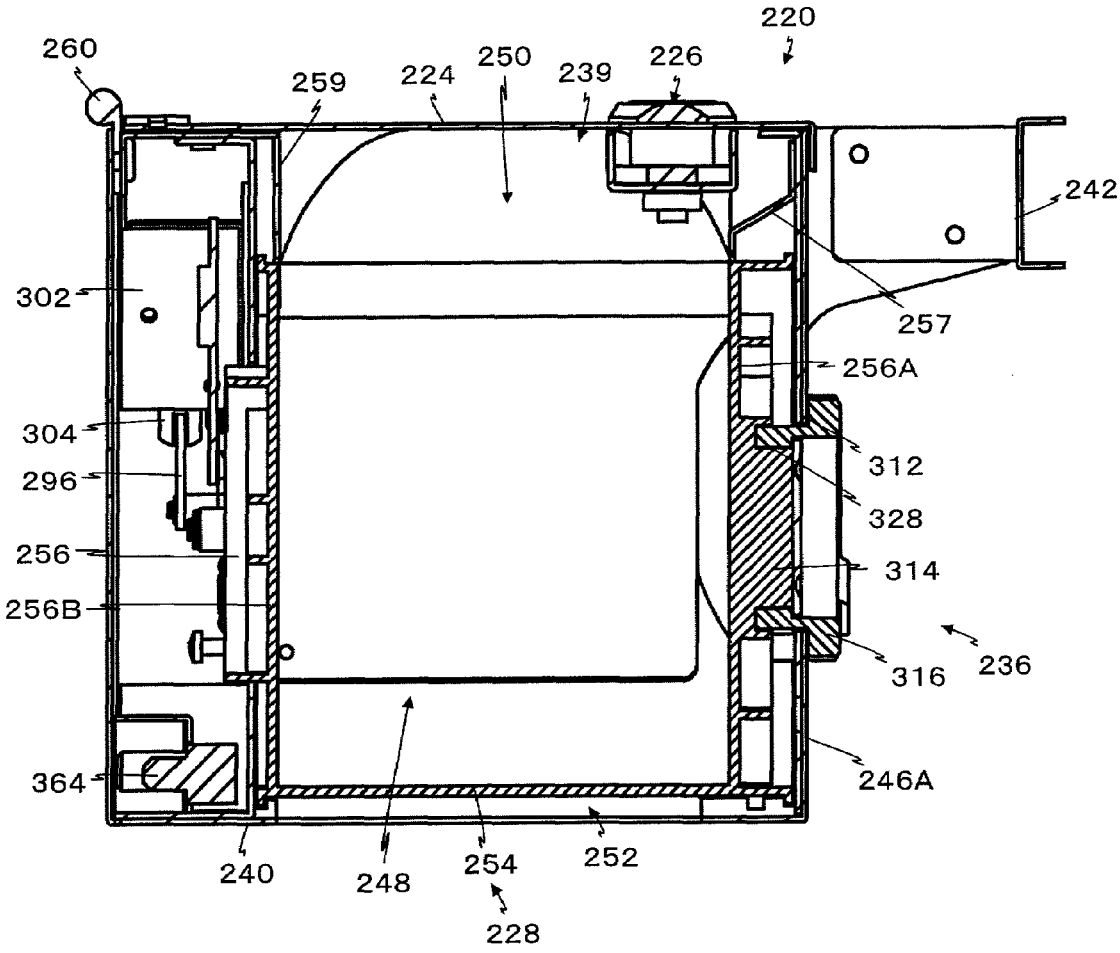
FIG. 7 is a sectional view taken along line A-A in FIG. 6.

Further, one end of a first step cover 257 is fixed opposite to an upper peripheral face of the circular side plate 256A on an inner face of the side plate 246A (see FIG. 7). The first step cover 257 is bent into a crank shape (see FIGS. 7 and 11), and a lower end thereof is formed into an arc shape along the outer periphery of the circular side plate 256A so that no step is formed within the safe chamber 248 owing to the thickness of the circular side plate 256A. "No step is formed" means that no coin can be positioned on a step and held thereon. Therefore, even if there is a step like the first embodiment, no step is formed when coins slide down the slope due to their own weight.

A second step cover 259 is disposed opposite to an upper peripheral face of the circular side plate 256B. A lower end of the second step cover 259 is formed into an arc shape along the peripheral face of the circular side plate 256B so that no step is formed in the safe chamber 248 by the circular side plate 256A. The second step cover 259 is formed at one end of a bearing 260 of the replenishing door 224.

Next, a shutter position regulating apparatus 261 will be explained (see FIG. 10). The shutter position regulating apparatus 261 has a function of regulating the position of the shutter plate 254 to a closing position CP or an opening position OP, and includes a stopper 263 and an arc-shaped long hole 265. The stopper 263 is caused to project from a side face of the circular side plate 256A to penetrate and be journalled within the arc-shaped long hole 265 of the side plate 246A. Specifically, when the shutter plate 254 is positioned at the closing position CP at which the shutter plate 254 faces the outlet opening 252 and closes the outlet opening 252, the stopper 263 is engaged on a right end 265R of the arc-shaped long hole 265 in FIG. 10 and is blocked from further rotation. On the other hand, when the shutter plate 254 is positioned at the opening position OP at which the outlet opening 252 is opened, the stopper 263 is engaged on a left end 265L of the arc-shaped long hole 256 and blocked from further rotation.

Next, the shutter locking unit 232 will be explained with reference to FIG. 9 and FIG. 10.

The shutter locking unit 232 has a function of holding the shutter 228 at the closing position CP. In the first embodiment, the shutter locking unit 232 has a function of preventing the shutter plate 254 from rotating. The shutter locking unit 232 includes a rotable member to be engaged 233 and an engaging member 258 which work in conjunction with the shutter plate 254. The member to be engaged 233 can comprise engaging teeth or ribs 264 formed radially at predetermined intervals on a peripheral face of a circular projection 262 projecting on a side face of the circular side plate 256B and projecting from a circular hole 267 of the side plate 264B. The engaging member 258 is a pivotable lever, the middle of which is swingably attached on a fixing shaft 266 projecting laterally from the side plate 246B lateral to the circular projection 262, and a hook 268 is positioned at its distal end to hook one of the engaging ribs 264.

The engaging member 258 is biased by a first spring 274, one end of which is engaged on a screw 272 projecting from the side plate 246B so that the hook 268 is biased to engage the engaging ribs 264. Generally, since the hook 268 engages any one of the engaging ribs 264, the circular projection 262, accordingly, the shutter plate 254 cannot rotate freely.

Figure 11:
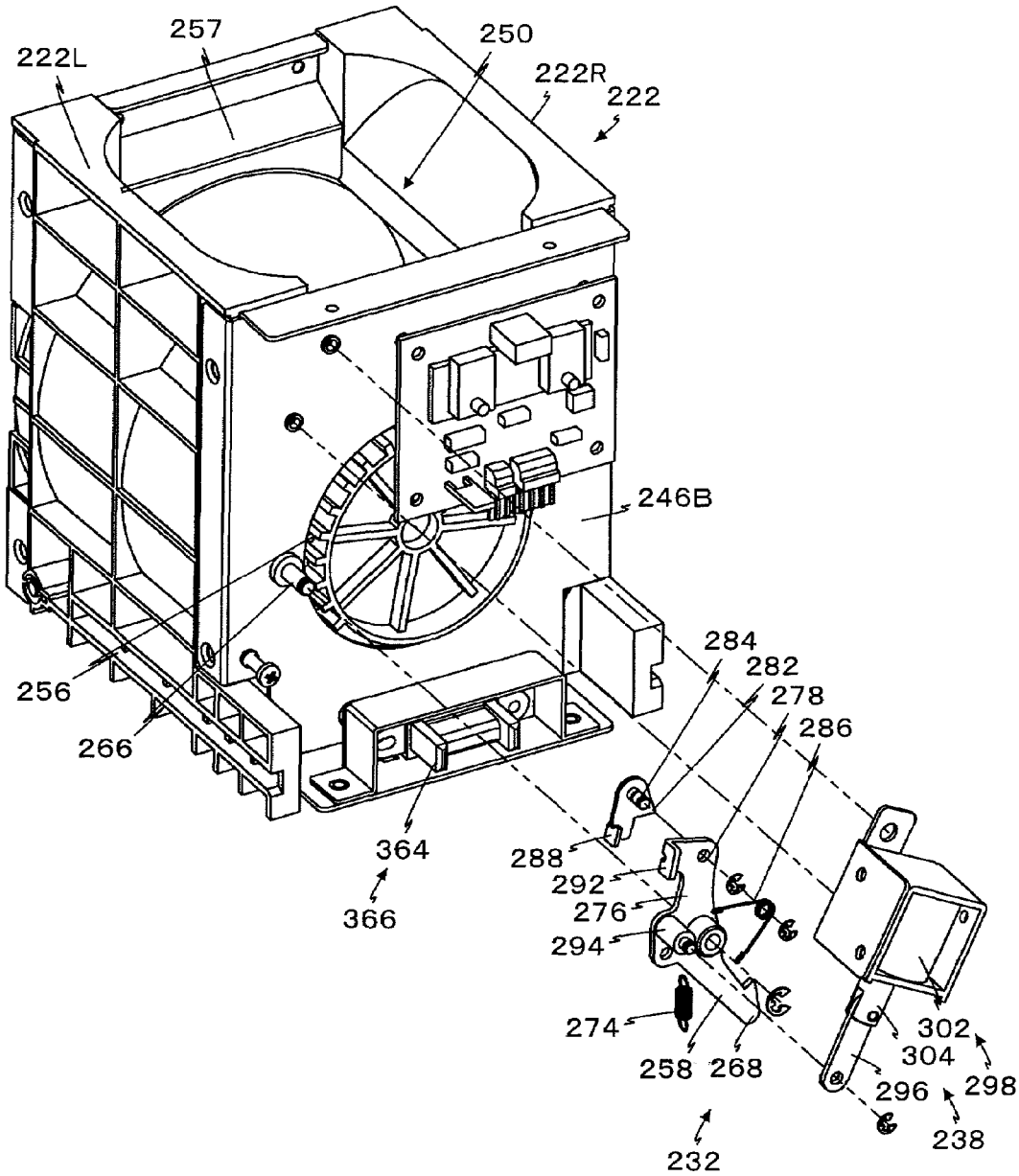
FIG. 11 is an exploded perspective view of a shutter locking mechanism of the coin replenishing safe of the first embodiment of the present invention.

Next, a return preventing unit 275 for the shutter 254 will be explained with reference to FIG. 9 and FIG. 11. The return preventing unit 275 has a function of blocking rotation of the shutter plate 254 in a closing direction and allowing only a rotation in an opening direction when the hook 268 of the shutter locking unit 232 prevents the engaging of an engaging rib 264.

Specifically, by rotatably inserting a shaft 284 of a return blocking hook 282 into a shaft hole 278 of a distal end portion of the lever 276 to extend approximately opposite to the engaging member 258, and engaging one end of a second spring 286 wound on the shaft 284 on a engaging piece 288, the return blocking hook 282 is biased so as to project on the side of the engaging rib 264. Incidentally, the other end of the second spring 286 is engaged on an engaging portion 292 of the lever 276. Thereby, generally, the hook 268 is held by the first spring 274 at a locking position RP at which the engaging rib 264 is engaged (see FIG. 9).

When the hook 268 of the shutter locking unit 232 is held at an unlocking position SCP at which the hook 268 is released from the engaging rib 264 by the shutter unlocking unit 238 which will be explained next, the return blocking hook 282 projects into a rotation path of the engaging rib 264 to be engaged on the engaging rib 264, thereby blocking any rotation in the opposite direction. When the engaging rib 264 is rotated in an opening direction of the shutter plate 254 in this state, a slope 285 of the back face of the return blocking hook 282 is pushed by the engaging rib 264 against a biasing force of the second spring 286, the return blocking hook 282 retreats from a moving path of the engaging rib 264, so that the shutter plate 254 can rotate in the opening direction.

Next, the shutter unlocking unit 238 will be explained with reference to FIG. 9 and FIG. 11. The shutter unlocking unit 238 has a function of canceling an immovable state of the shutter plate 254 caused by the shutter locking unit 232.

In the first embodiment, the shutter unlocking unit 238 includes a second fixing shaft 294 projecting laterally from an eccentric position with respect to the fixing shaft 266 serving as a swing spindle of the lever 276, a link 296, and a solenoid 302 which is an electromagnetic actuator 298. The solenoid 302 is fixed on the side plate 246B, and an iron core 304 thereof is link-coupled to the second fixing shaft 294 via the link 296.

When the solenoid 302 has been demagnetized, the engaging hook 268 is pulled by the first spring 274, and held at the locking position RP. When the solenoid 302 is excited, since the iron core 304 is pulled upward in FIG. 9, the engaging member 258 is rotated in a clockwise direction about the fixing shaft 266 via the link 296. Thereby, the engaging member 258 is held at the unlocking position SCP, and the lock of the shutter plate 254 is indirectly unlocked.

Next, the shutter opening unit 236 will be explained with reference to FIG. 7, FIG. 10, and FIG. 13. The shutter opening unit 236 has a function of moving the shutter 228 to the opening position OP, in other words, a function of moving the shutter plate 254 from the closing position CP of the outlet opening 252 to the opening position OP.

In the first embodiment, the shutter opening unit 236 is a ring-shaped operating handle 316 projecting laterally from the circular side plate 256A and attached to a cylindrical portion to be moved 314 penetrating a circular hole 312 of the side plate 246A. It is preferable that a torque limiter 318 is interposed between the portion to be moved 314 and the handle 316 (see FIG. 13). This is for preventing breakage of any parts and any attempted wrongdoing caused by moving the shutter plate 254 with a large force.

The torque limiter 318 causes the handle 316 to rotate idly to prevent movement of portion 314, accordingly, the shutter plate 254 is not moved when a torque applied to the portion to be moved 314 from the handle 316 reaches a predetermined value or more. As shown in FIG. 13, the torque limiter 318 is configured so as to bias balls 326A and 326B outward by third springs 324A and 324B disposed in holding grooves 322A and 322B extending in a circumferential direction with respect to a rotational axis line of the portion to be moved 314, and to push out the balls 326A and 326B to semicircular recessed portions 332A and 332B formed on an inner peripheral face 328 of a circular hole of the handle 316 when fitted rotatably on the outer periphery of the portion 314. The third spring 324A and 324B and the balls 326A and 326B are held in the holding grooves 322A and 322B by a holding plate 334 fixed with screws or the like on a side face of the portion 314.

With this configuration, since the balls 326A and 326B are pushed into the holding holes 322A and 322B by slopes of the recessed portions 332A and 332B when torque equal to or more than a predetermined value is applied to the handle 316, the handle 316 rotates relative to the portion 314 so the shutter plate 254 does not move. Thereby, since breakage of the shutter plate 254 or the like caused by rotating the handle 316 forcibly can be prevented, obtaining coins wrongly can be prevented.

Next, the safe casing 240 will be explained. The safe casing 240 has a function of protecting the replenishing safe main body 222 from willful destruction. The safe casing 240 has a boxy safe configuration made of a plate metal such as stainless steel, and the replenishing safe main body 222 is inserted into the safe casing 240. A carrying handle 242 is formed integral with the replenishing safe main body 222.

Next, the replenishing door 224 will be explained. The replenishing door 224 has a function of covering an upper-face opening 239 of the safe casing 240 to enable an opening and closing of the replenishing hole 250 of the replenishing safe main body 222. The replenishing door 224 is a rectangular-plate-like body, and one end is pivotally attached to the bearing 260 fixed on the side plate 246B.

Figure 5:
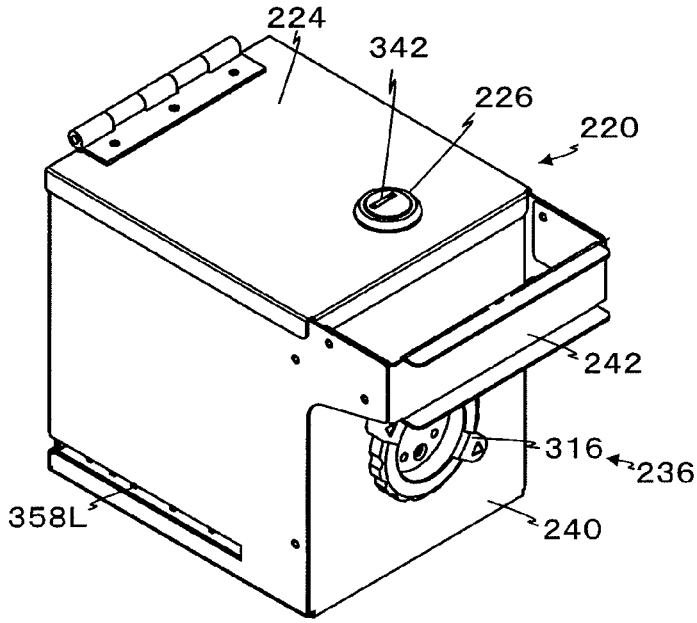
FIGS. 5A and 5B are perspective views of a coin replenishing safe of the first embodiment of the present invention.
Figure 5:
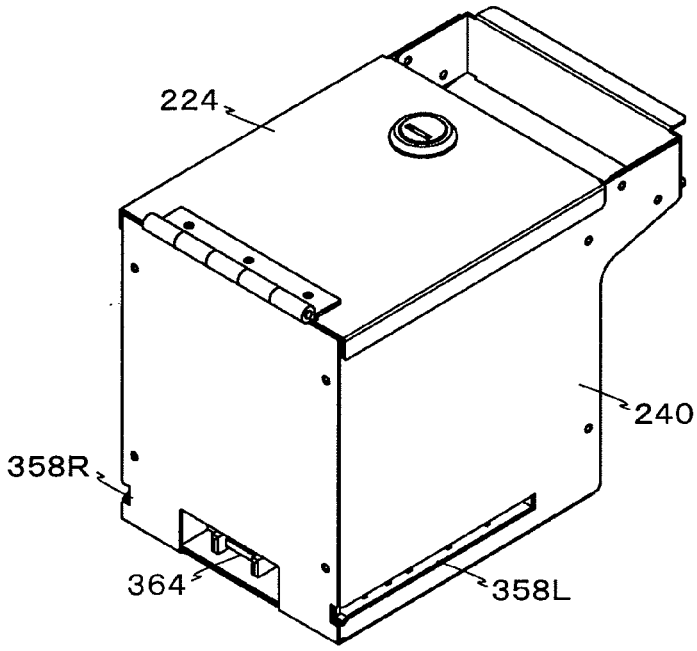
Figure 6:
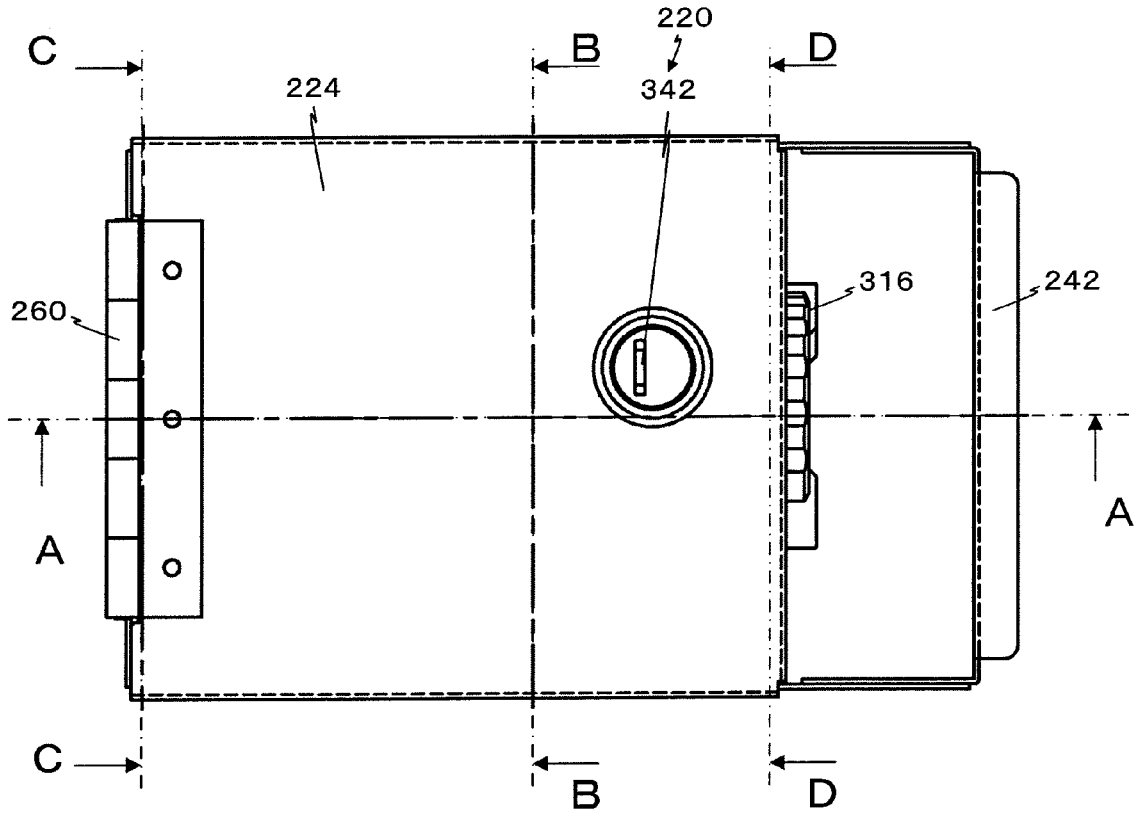
FIG. 6 is a plan view of the coin replenishing safe of the first embodiment of the present invention.

Next, the replenishing door locking apparatus 226 will be explained with reference to FIG. 5, FIG. 7, and FIG. 10. The replenishing door locking apparatus 226 has a function of locking or unlocking the replenishing door 224 on the safe casing 240. In the first embodiment, the replenishing door locking apparatus 226 locks the replenishing door 224 by inserting a key into a keyhole 342 of the upper face of the replenishing door 224 and turning the key in a predetermined direction to cause a engaging piece 344 to engage a bent portion 346 of the side plate 246A. When the replenishing door 224 is opened, the bent portion 346 is released from the engaging piece 344 by inserting the key into the keyhole 342 and turning it in the direction opposite to the above direction, and the replenishing hole 250 is opened by pivoting the replenishing door 224 upward on the bearing 260 serving as a fulcrum.

The coin receiving and dispensing machine 100 includes main body locking unit 234 and an attachment apparatus 241 for the coin replenishing safe 220. First, the attachment apparatus 241 for attaching the coin replenishing safe 220 to the coin receiving and dispensing machine 100 will be explained with reference to FIG. 3 to FIG. 5, and FIG. 19.

The attachment apparatus 241 has a function of attaching the coin replenishing safe 220 so as not to be attached to and detached from the coin receiving and dispensing machine 100. The attachment apparatus 241 includes a main body engaging portion 352 of the main body 131 and a replenishing apparatus engaging portion 354 of the coin replenishing safe 220, and the replenishing apparatus engaging portion 354 is engaged on the main body engaging portion 352 so that the coin replenishing safe 220 cannot be detached from the main body 131 from any direction other than a predetermined direction. The main body engaging portion 352 of the first embodiment comprises engaging rails 356L and 356R with a rectangular section and with a predetermined length projecting laterally from the left and right sidewalls of the mounting recessed portion 133. The replenishing apparatus engaging portion 354 comprises engaging recessed grooves 358L and 358R with a predetermined length extending laterally, which are formed at lower portions of the left and right sidewalls of the replenishing safe main body 222.

By flipping up the dropping port cover 120, the engaging rails 356L and 356R are exposed. Since the engaging rails 356L and 356R are advanced into the engaging recessed grooves 358L and 358R, respectively, by pushing in the coin replenishing safe 220 along the bottom face 133B of the mounting recessed portion 133, the coin replenishing safe 220 cannot be detached unless pulled back. At this time, a female connector 362 fixed on the main body 131 is fitted on a male connector 364 of the main body 131 to form the connectors 366. The connector 364 is connected to the solenoid 302 via a lead wire (not shown).

Next, the main body locking unit 234 will be explained with reference to FIG. 12. The main body locking unit 234 has a function of making it impossible to detach the coin replenishing safe 220 from the main body 131. In other words, the main body locking unit 234 makes the coin replenishing safe 220 impossible to move with respect to the main body 131 when the coin replenishing safe 220 is attached on the main body 131 by the attachment apparatus 241.

The main body locking unit 234 includes a engaging hook 370 advanced to and retreated from the bottom face 133B of the mounting recessed portion 133 and a receiving hole 372 (see FIG. 18) formed on a bottom face of the coin replenishing safe 220.

First, the engaging hook 370 will be explained. The engaging hook 370 is a projection 378 projecting upward at a distal end of a swing lever 376 which is attached swingably on a fixed shaft 374 that is fixed in the main body 131. The projection 378 includes a pass-allowable slope 379 inclined upward from the side of the front face 131F of the main body 131 in a rearward direction. The projection 378 is caused to project resiliently into the mounting recessed portion 133 from a through-hole 382 formed on the bottom face 133B by a fourth spring 390 which will be described later.

Next, an actuator 384 for movement of the engaging hook 370 will be explained. The actuator 384 has a function of swinging the swing lever 376 about the fixed shaft 374 accordingly to cause the projection 378 to advance into and retreat from the mounting recessed portion 133. In the first embodiment, the actuator 384 is a solenoid 386, and an iron core 388 of which is link-coupled to the middle of the swing lever 376. The iron core 388 is biased by the fourth spring 390 so as to project from the solenoid 386.

Figure 12:
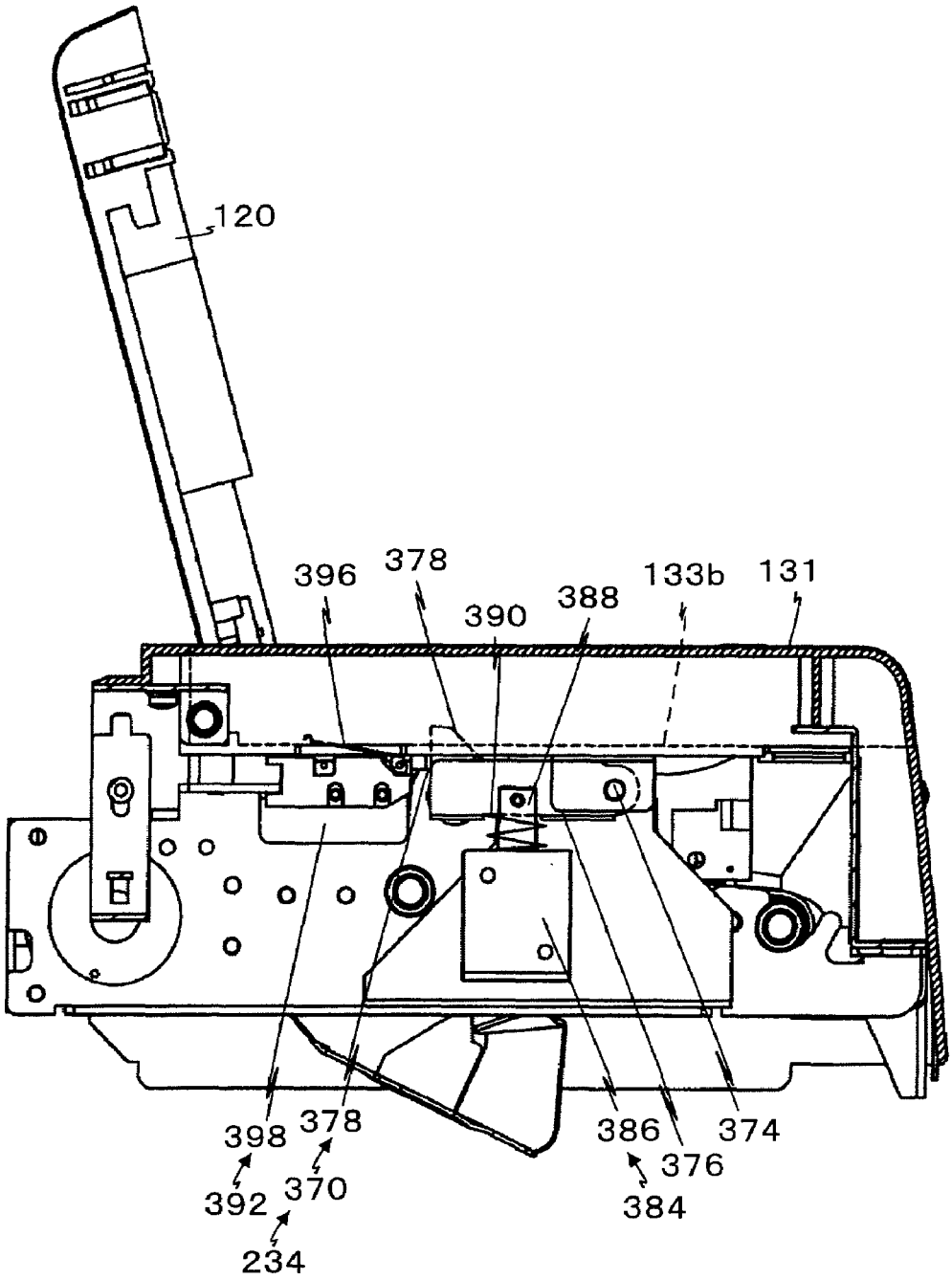
FIG. 12 is an explanatory view of a main body locking mechanism of the coin replenishing safe of the first embodiment of the present invention.

Thereby, the swing lever 376 is generally swung in a clockwise direction in FIG. 12, and the projection 378 is caused to project into the mounting recessed portion 133. When the solenoid 386 is excited, the iron core 388 is pulled into the solenoid 386 against a spring force of the fourth spring 390, so that the swing lever 376 is swung in a counterclockwise direction in FIG. 12, and the projection 378 retreats from the mounting recessed portion 133, in other words, retreats from the receiving hole 372 of the coin replenishing safe 220.

Next, mounting detecting unit 392 for detecting a mounting of the coin replenishing safe 220 to the main body 131 will be explained. The mounting detecting unit 392 has a function of detecting when the coin replenishing safe 220 has been mounted on the main body 131 and has been input a state in which coins in the safe chamber 248 can be input to the coin receiving port 118. In the first embodiment, the mounting detecting unit 392 is a micro switch 398 in which a piece to be moved 396 is disposed in a detecting hole 394 disposed on the bottom face 133B below the engaging rail 356L and between the through-hole 382 and the connector 362.

In a state in which the coin replenishing safe 220 is mounted on the main body 131 by the attachment apparatus 241, the connector 364 advances into the connector 362, and contacting pieces of the connector 366 are connected, the piece to be moved 396 in the detecting hole 394 is pushed down by the bottom face of the coin replenishing safe 220, and the micro switch 398 outputs an ON signal. At this time, the outlet opening 252 faces the coin receiving port 118.

Next, an apparatus 400 for preventing the shutter 228 from being left open will be explained (see FIG. 13). The apparatus 400 for preventing the shutter 228 from being left open includes a fitting hole 402 formed on a side face of the mounting recessed portion 133, and a engaging pin 404 and unlocking preventing unit 406 which are attached to the coin replenishing safe 220. The engaging pin 404 is biased by a built-in fifth spring 408 to project from the coin replenishing safe 220, and can advance into and retreat from the fitting hole 402 when the coin replenishing safe 220 is attached on the main body 131. Therefore, when the engaging pin 404 has advanced in the fitting hole 402, it is impossible to detach the coin replenishing safe 220 from the main body 131.

Next, the unlocking preventing unit 406 will be explained. The unlocking preventing unit 406 has a function of blocking the engaging pin 404 from retreating from the fitting hole 402 when the shutter plate 254 has not yet closed the outlet opening 252. The unlocking preventing unit 406 includes a swing lever 412 swinging in conjunction with movement of engaging pin 404, the fifth spring 408, and a cam 419. The swing lever 412 is swingably attached on a third fixed shaft 414, a lower end of which is link-coupled to the engaging pin 404.

A second portion 418 to be moved is capable of advancing into and retreating from a rotational region of the peripheral face of the circular side plate 256A and is formed at an upper end of the swing lever 412. The cam 419 rising with a predetermined radius is formed at one portion of the peripheral face of the circular side plate 256A. When the second portion 418 of the swing lever 412 is brought into contact with the cam 419, the engaging pin 404 is retreated from an outer surface of the coin replenishing safe 220. In this state, the shutter plate 254 is positioned at the closing position CP where the outlet opening 252 is closed.

Figure 13:
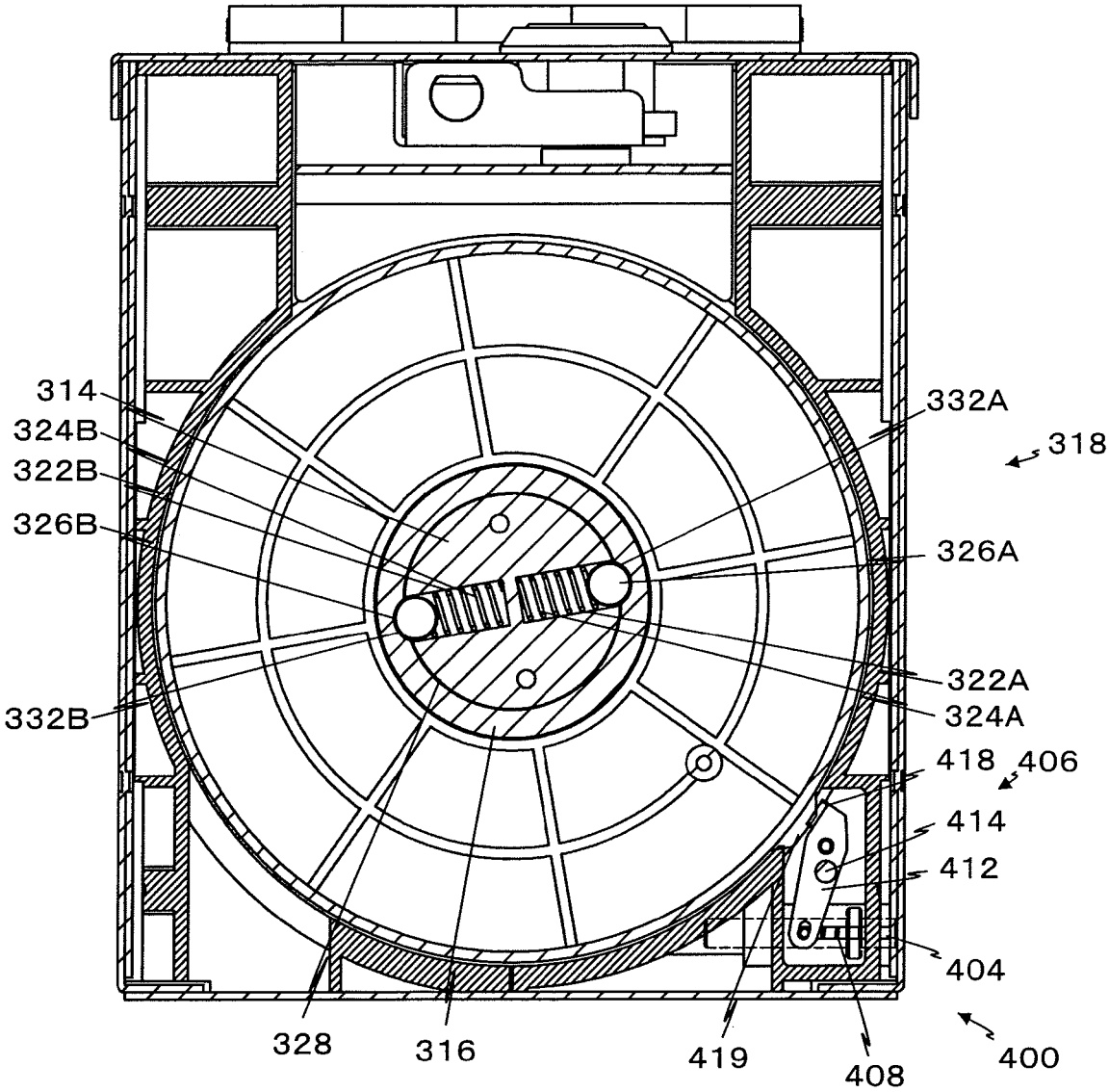
FIG. 13 is a sectional view taken along line D-D in FIG. 6.

When the shutter plate 254 is positioned at the opening position OP, since the second portion to be moved 418 of the swing lever 412 is released from the cam 419, and faces the peripheral face 416 of the circular side plate 256A, the swing lever 412 becomes capable of swinging in a counterclockwise direction in FIG. 13, so that the engaging pin 404 is caused to project beyond the outer surface of the coin replenishing safe 220 by the fifth spring 408. Thereby, when the outlet opening 252 of the coin replenishing safe 220 has opened, the coin replenishing safe 220 cannot be detached from the coin receiving and dispensing machine 100.

Figure 14:
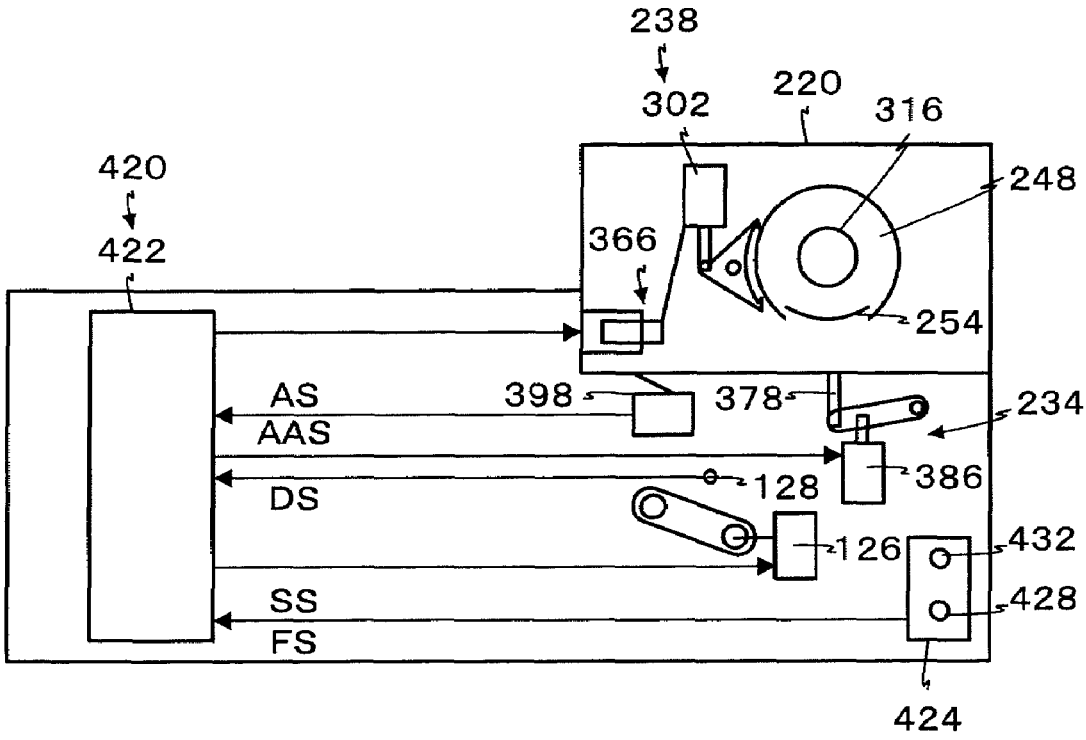
FIG. 14 is a block diagram of the coin replenishing apparatus of the first embodiment of the present invention.

Next, the main-body-side control apparatus 420 will be explained with reference to FIG. 14. In the first embodiment, the main-body-side control apparatus 420 is, for example, a micro computer 422, which receives signals from the coin sensor 128, the micro switch 398, and an operation panel 424, and turns ON and OFF the first solenoid 302 of the shutter unlocking unit 238 and the second solenoid 386 of the main body locking unit 234 according to a predetermined procedure. The operation panel 424 includes a replenishment start button 428 and a replenishment end button 432.

Figure 15:
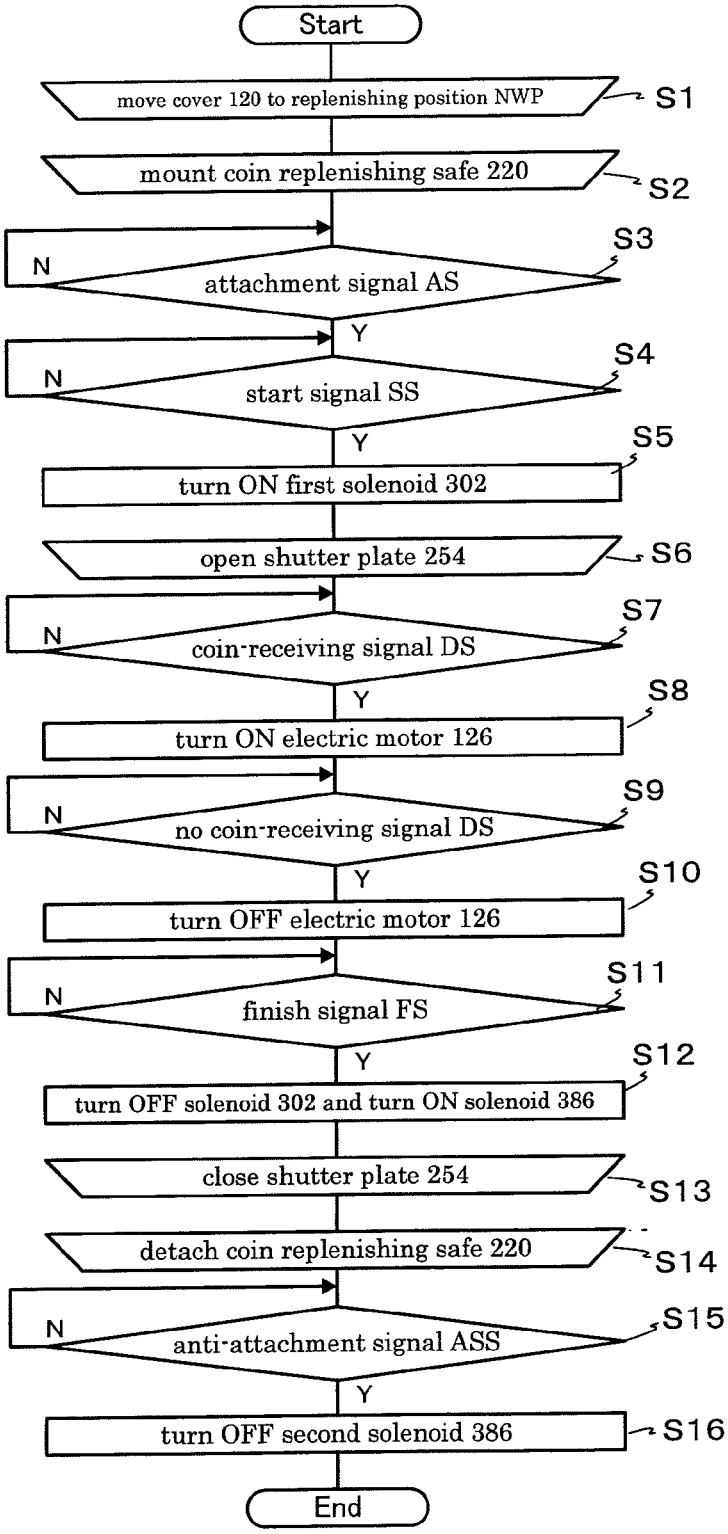
FIG. 15 is a flowchart for explaining the operation of the coin replenishing apparatus of the first embodiment of the present invention.

Next, an operation of the coin replenishing apparatus 100 of the first embodiment will be explained with reference to the flowchart of FIG. 15 and the explanatory views of FIG. 16 to FIG. 22.

First, as replenishment preparatory work, replenishment preparation is performed by dropping a predetermined number of coins of predetermined kinds into the coin replenishing safe 220. Specifically, after a coin manager unlocks the replenishing door 224 by inserting a predetermined key into the keyhole 342 of the replenishing door locking apparatus 226 of the coin replenishing safe 220 and turning the key in a predetermined direction, he/she opens the replenishing hole 250 by pivoting the replenishing door 224 upward on the bearing 260 serving as a fulcrum. After he/she drops a predetermined number of coins of predetermined kinds in the safe chamber 248 from the replenishing hole 250, he/she closes the replenishing door 224, and locks the replenishing door 224 by the replenishing door locking apparatus 226.

Figure 8:
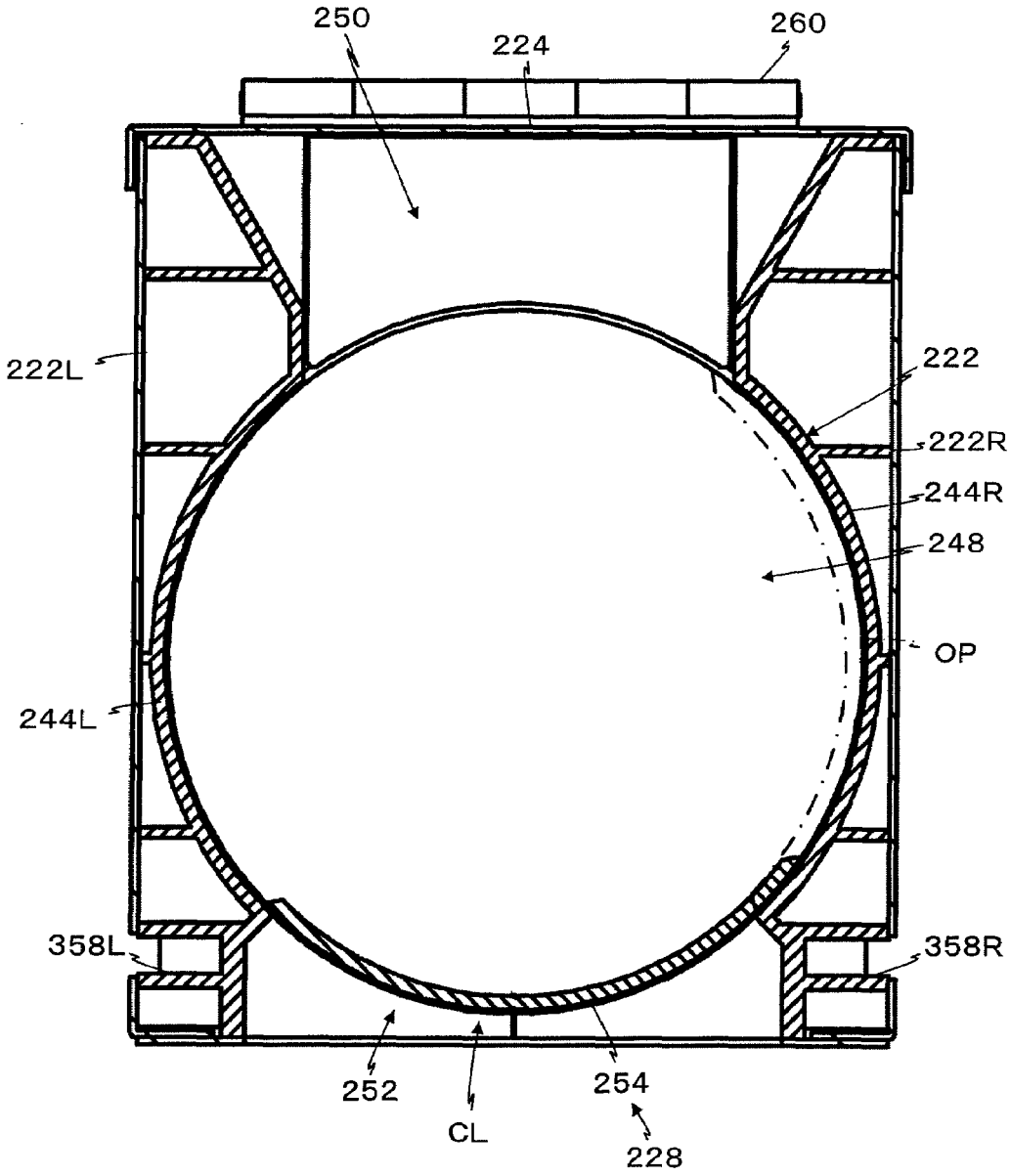
FIG. 8 is a sectional view taken along line B-B in FIG. 6.
Figure 9:
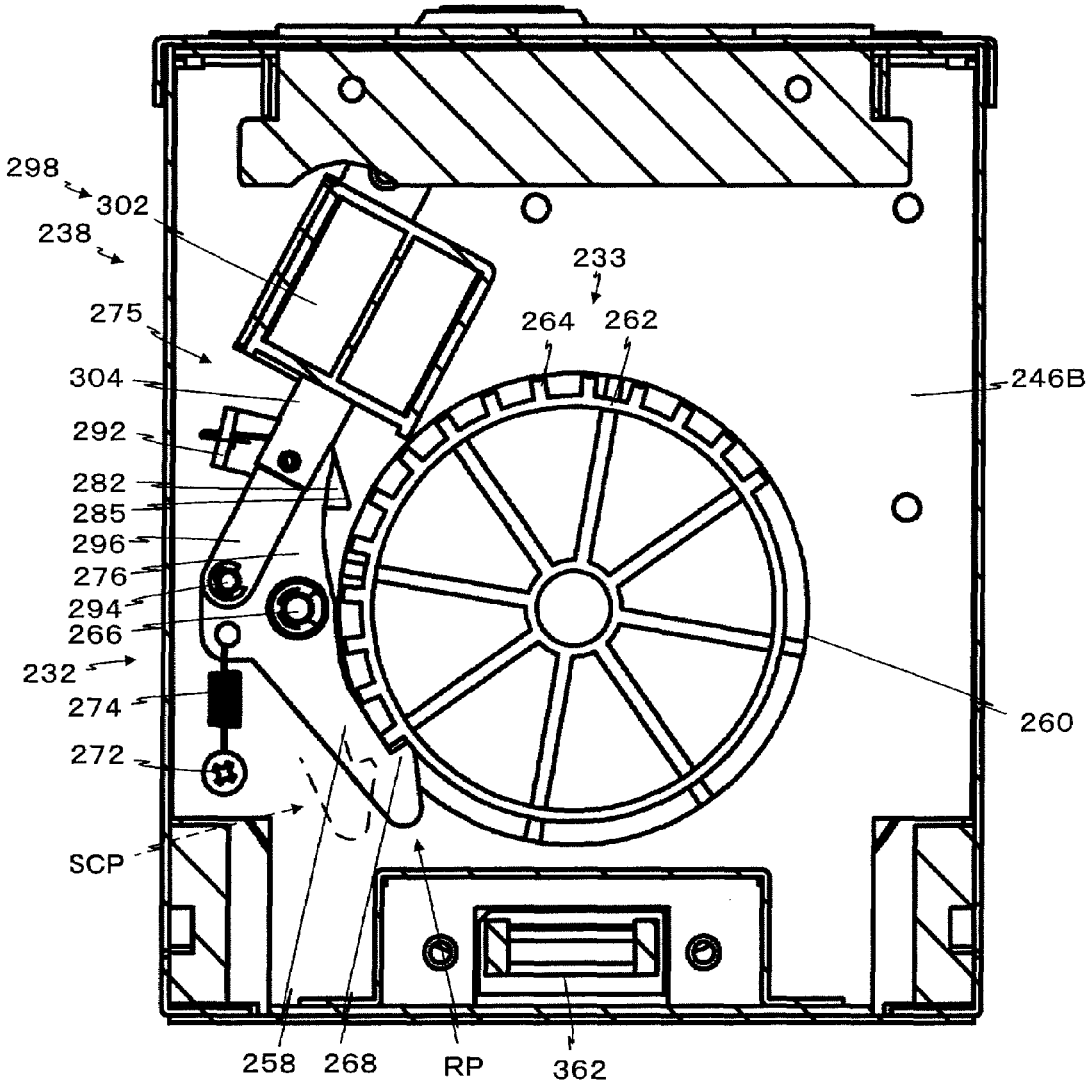
FIG. 9 is a sectional view taken along line C-C in FIG. 6.

At this time, since the first solenoid 302 of the shutter locking unit 232 is not connected to a power supply, the hook 268 engages the engaging rib 264, and the shutter plate 254 is held at the closing position CP of the outlet opening 252 (see FIGS. 8 and 9). Thereby, no one can access the coins in the safe chamber 248 unless he/she has the key of the replenishing door locking apparatus 226. Further, since the peripheral face of the circular side plate 256A is input contact with the second portion 418 of the swing lever 412 at the cam 419 as shown in FIG. 13, and the swing lever 412 is swung in a clockwise direction, the engaging pin 404 is retreated in the coin replenishing safe 220.

Next, coin replenishing work in the first embodiment will be explained with reference to the flowchart shown in FIG. 15. First, the dropping port cover 120 is moved to a replenishing position NWP at step S1. Specifically, the coin dropping cover 120 is moved toward the front of the main body 131 against the attracting force between the magnets 136L and 136R and the iron pieces 137L and 137R to project the distal end of the dropping port cover 120 slightly from the front face 131F of the main body 131 within the range of the long hole 135.

Next, the coin dropping cover 120 is rotated upward on the pivot shaft 134 serving as a fulcrum by pushing up the projecting distal end thereof from below, and is held at the replenishing position NWP in an approximately-inverted state by leaning its upper face on the main body 131. In this manner, preparation of the coin receiving and dispensing machine is performed.

Next, at step S2, a worker attaches the coin replenishing safe 220 to the attachment apparatus 241 of the coin receiving and dispensing machine 100. That is, he/she places the coin replenishing safe 220 on the bottom face 133B on the side of the front face 131F of the mounting recessed portion 133, and pushes the safe 220 deep into the mounting recessed portion 133 in a state of being placed thereon. Thereby, the coin replenishing safe 220 advances to the side of the connector 362 while its left and right sidewalls are guided by the left and right sidewalls of the mounting recessed portion 133, and in the course of the movement, the engaging recessed grooves 358L and 358R of the coin replenishing safe 220 fit on the engaging rail 356L and 356R, respectively, so that the replenishing safe main body 222 cannot be pulled upward.

When the coin replenishing safe 220 is further pushed in, the pushing pass-allowable slope 379 of the projection 378 is pushed by a front end of the coin replenishing safe 220, and the swing lever 376 is swung in a counterclockwise direction in FIG. 12 against a spring force of the fourth spring 390, so that the coin replenishing safe 220 can further advance to the side of the connector 362. When the coin replenishing safe 220 is further pushed forward to the side of the connector 364, the connector 364 enters the connector 362 of the coin receiving and dispensing machine 100, and connecting terminals of the connector 366 are connected. Since the piece 396 to be moved of the micro switch 398 of the mounting detecting unit 392 is pushed down by the bottom face of the coin replenishing safe 220 just after the connection, the micro switch 398 turns ON to output a mounting signal AS.

Figure 16:
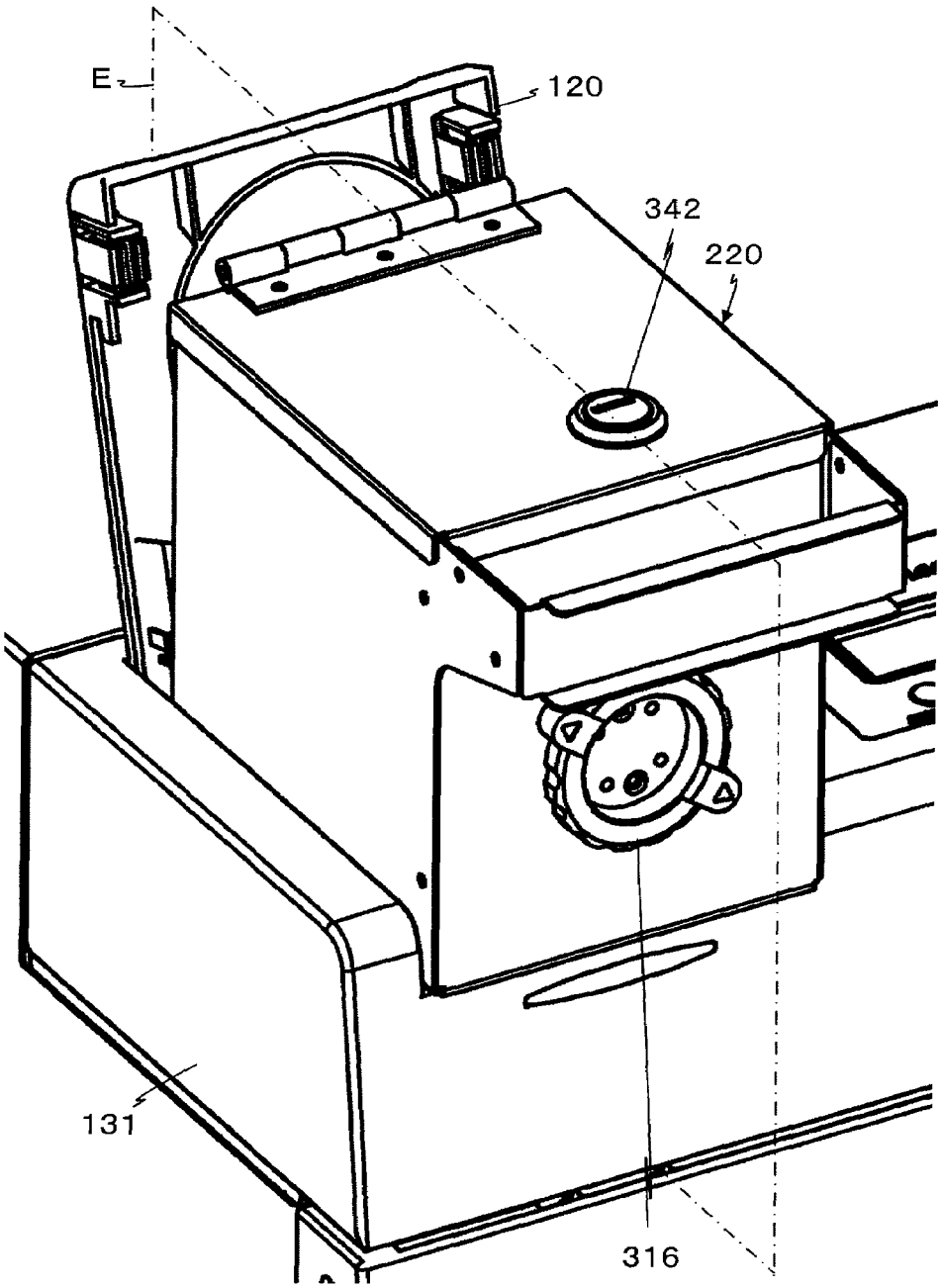
FIG. 16 is an enlarged perspective view of a state in which the coin replenishing safe of the first embodiment of the present invention is mounted on the coin receiving and dispensing machine.
Figure 18:
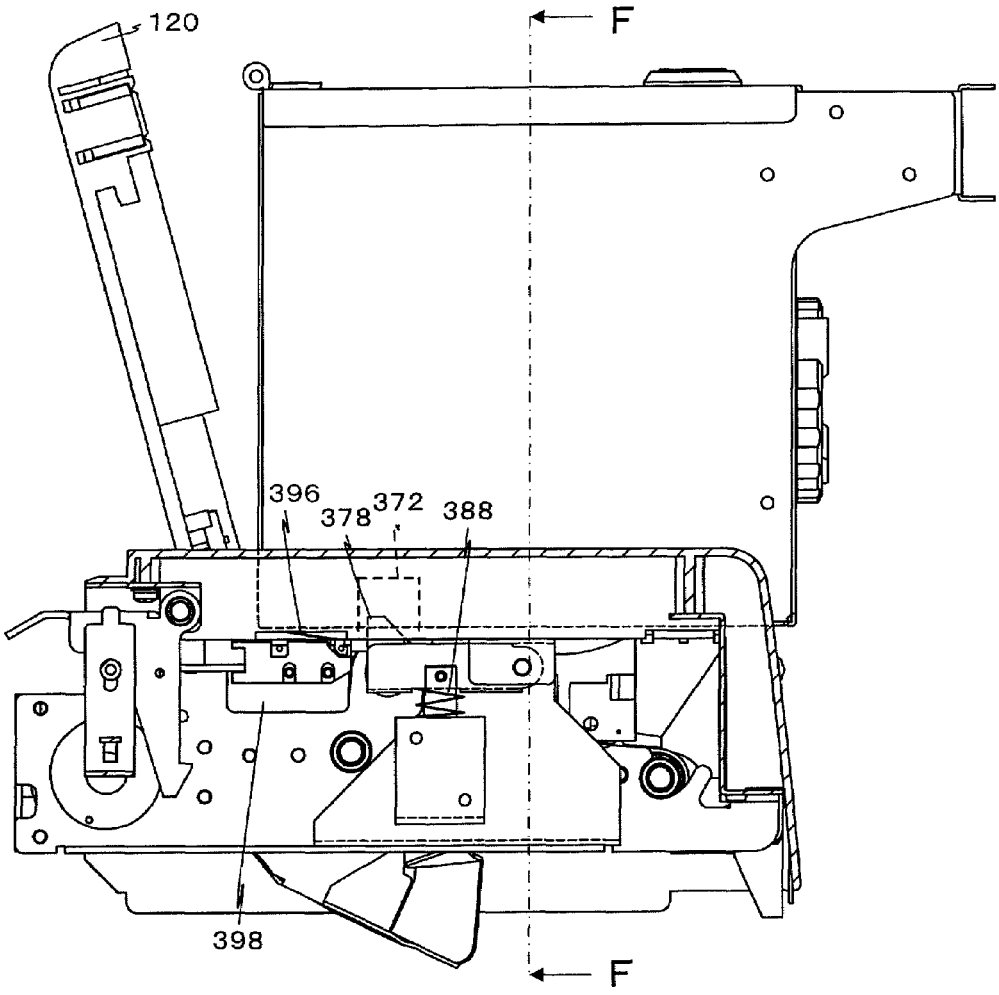
FIG. 18 is a sectional view of the main body locking mechanism in the state in which the coin replenishing safe of the first embodiment of the present invention is mounted on the coin receiving and dispensing machine.

The coin replenishing safe 220 is pushed in up to a state in which the coin replenishing safe 220 cannot further be pushed in because the connector 366 is blocked by the connector 364 (from a position shown in FIG. 16 to a position shown in FIG. 18). In this state, since the projection 378 faces the receiving hole 372 of the coin replenishing safe 220, and is caused to enter the receiving hole 372 by the fourth spring 390, the coin replenishing safe 220 cannot be pulled back to the side of the front face 131F of the main body 131.

In other words, since the engaging recessed grooves 358L and 358R are engaged with the engaging rails 356L and 356R, and the coin replenishing safe 220 is blocked from being pulled back by the projection 378, and besides cannot advance because of the connector 364, the coin replenishing safe 220 cannot be detached from the coin receiving and dispensing machine 100. At this time, as shown in FIG. 19, since the shutter plate 254 closes the outlet opening 252, the coins in the safe chamber 248 cannot drop into the coin input port 138. In this state, the engaging pin 404 has faced the fitting hole 402.

When the mounting signal AS is detected at step S3, the processing proceeds to step S4, and waits until the replenishment start button 428 is pushed. When the replenishment start button 428 is pushed and a start signal SS is outputted at step S4, the processing proceeds to step S5. At step S5, the main body control apparatus 420 excites the first solenoid 302 of the shutter unlocking unit 238 of the coin replenishing safe 220.

Since the engaging member 258 is swung in a clockwise direction in FIG. 9 due to excitation of the first solenoid 302, the hook 268 releases the engaging rib 264, and the return blocking hook 282 becomes capable of engaging the engaging rib 264. Therefore, when the handle 316 of the shutter opening unit 236 is swung in a clockwise direction in FIG. 16, the shutter plate 254 is moved in a rotating manner via the torque limiter 318, so that the outlet opening 252 can be opened.

Figure 21:
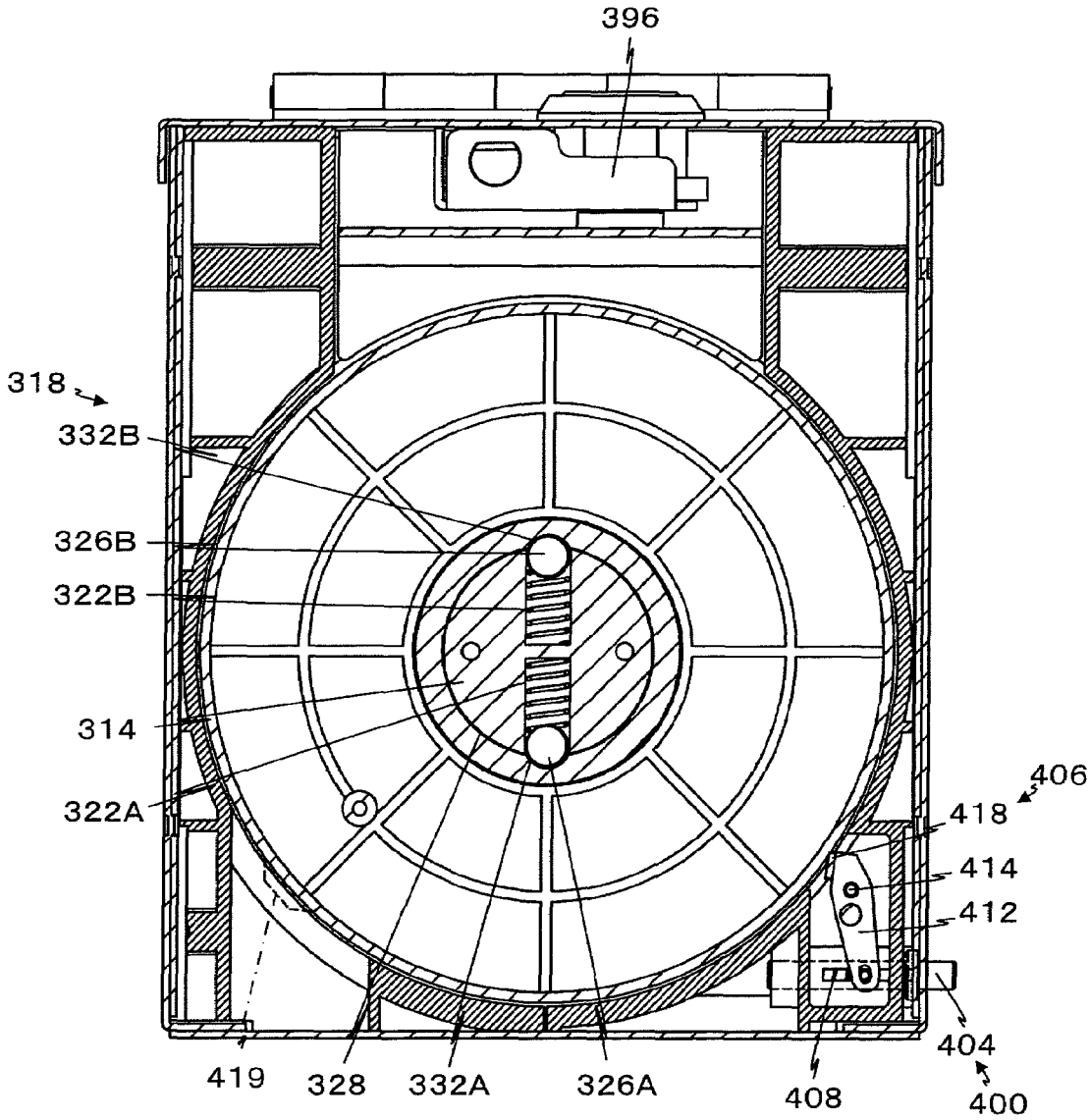
FIG. 21 is a sectional view of the shutter locking mechanism in the state in which the coin replenishing safe of the first embodiment of the present invention is mounted on the coin receiving and dispensing machine and in a state in which the main body locking mechanism is unlocked.

When the shutter plate 254 is positioned at the opening position OP of the outlet opening 252, the cam 419 is released from the second portion to be moved 418 of the swing lever 412, and the second portion to be moved 418 faces the peripheral face 416 of the circular side plate 256A, so that the swing lever 418 is swung in a counterclockwise direction by the fifth spring 408, and the engaging pin 404 link-coupled projects outside the coin replenishing safe 220 and enters the fitting hole 402 (see FIG. 21). Thereby, when the outlet opening 252 is opened, the coin replenishing safe 220 cannot be detached from the main body 131.

Figure 20:
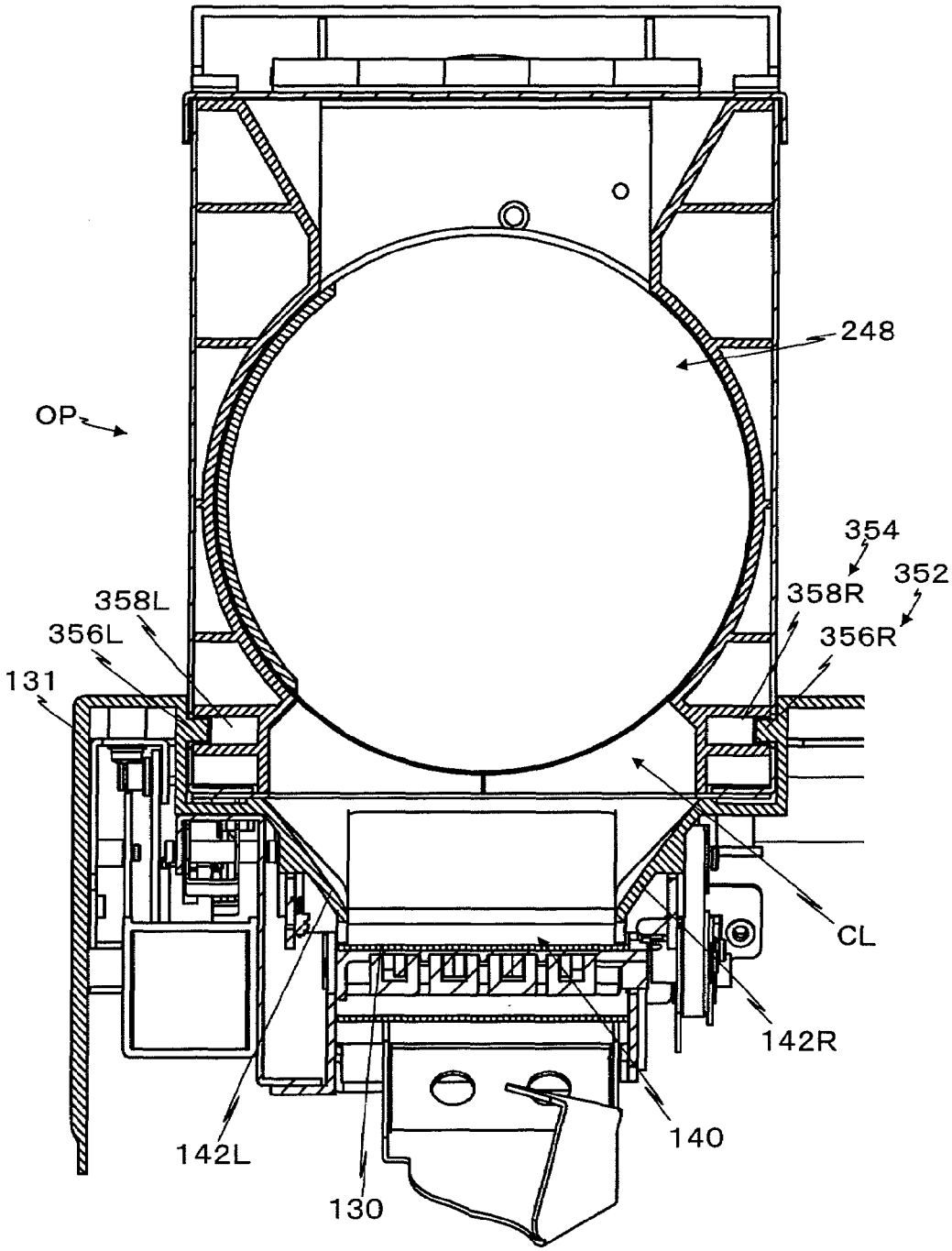
FIG. 20 is a sectional view taken along line F-F in FIG. 18 in the state in which the coin replenishing safe of the first embodiment of the present invention is mounted on the coin receiving and dispensing machine and in the state in which an outlet opening is opened.

Next, at step S6, the handle 316 is rotated in a clockwise direction in FIG. 16, the shutter plate 254 integrated with the handle 316 is swung integrally in the same direction, and rotated to the opening position OP where the stopper 263 is blocked from rotating by the left end 265L of the arc-shaped long hole 265 (see FIG. 20). At this time, when the handle 316 is rotated in the opposite direction, the return blocking hook 282 engages the engaging rib 264, therefore, though being reversely rotated only between the engaging ribs 264, the shutter plate 254 cannot substantially be rotated reversely.

In other words, when the shutter unlocking unit 238 is operating, the shutter plate 254 can rotate only in a direction for opening the outlet opening 252. When rotation of the shutter plate 254 is blocked by the left end 265L of the arc-shaped long hole 265, even if the handle 316 is further rotated in the same direction, only the handle 316 rotates idly due to torque limiter 318, so that the shutter plate 254 or the like is never broken. When the shutter plate 254 is positioned at the opening position OP, the outlet opening 252 is fully opened. Thereby, the coins in the safe chamber 248 are put onto the flat belt 130 via the coin dropping hole 138 (see FIG. 17).

Since the optical axis of the photoelectronic sensor 150 is cut by the replenishment coins, a coin-reception detecting signal DS is outputted at step S7, and the processing proceeds to step S8. At step S8, the electric motor 126 of the coin receiving apparatus 102 is rotated. Thereby, the upper face of the flat belt 130 is moved to the side of the separating and delivering apparatus 104 (leftward in FIG. 17), while the reverse roller 124 is rotated in a counterclockwise direction and the lower peripheral face of which is moved in a direction opposite to the direction in which the upper face of the flat belt 130 is moved.

Thereby, when the thinnest coins are stacked flat or two thinnest coins are stacked up, these coins are caused to pass below the lower peripheral face of the reverse roller 124, put from the downstream end portion of the coin-receiving flat belt 130, and input to the retaining bowl 174 of the separating and delivering apparatus 104 while being guided by a guide chute 436. When three coins are conveyed in a state of being stacked up, the lower two stacked coins pass below the reverse roller 124, while the top coin is prevent from advancing by the reverse roller 124, and moved relative to the lower coins. Thereby, the top coin is deviated with respect to the lower coins, and finally dropped onto the flat belt 130.

The dropped coin is conveyed again, similarly to the above, toward the separating and delivering apparatus 104 by advance of the flat belt 130. When the photo-electronic sensor 150 terminates outputting a signal on detecting coins, the electric motor 126 is stopped, and the advance of the flat belt 130 is stopped.

When coins that are separated, one by one, by the separating and delivering apparatus 104 are moved along the receiving member 176 by the rotating wiper 182, the authenticity and kinds of coins are identified by the coin-kind identifying apparatus 106. The coins are then advanced into the sorting apparatus 110 by the conveying apparatus 108 in a state in which its peripheral face is guided by the guide rail 186 and its lower face is supported by the slide plate 184. In the course of the advance, the coins are input to predetermined sorting holes according to the kinds of coins based upon the identified type of coin, and retained in the coin hoppers 210 corresponding to the kinds of coins.

When all the coins in the safe chamber 248 are put onto the flat belt 130, and all the coins are delivered to the next step, the photoelectronic sensor 150 detects no coin and therefore does not output the coin-reception detecting signal DS for a predetermined period of time. When the coin-reception detecting signal DS is not detected for a predetermined period of time at step S9, replenishment is treated as terminated and the processing proceeds to step S10, and after electric motor 126 is stopped, the processing proceeds to step S11.

Incidentally, when the coin-reception detecting apparatus 154 detects no coin, it is preferable to repeat an advancing and retreating motion of the flat belt 130 for a predetermined number of time periods, by repeating a reverse and normal rotation of the motor 126 a plural number of times, to prevent any coins from remaining on the flat belt 130.

When the replenishment end button 432 is pushed (see FIG. 23), the finish signal FS is outputted at step S11, and the main body control apparatus 420 turns ON the second solenoid 386 and turns OFF the first solenoid 302 at step S12. The iron core 388 is pulled in due to excitation of the second solenoid 386, the swing lever 376 is swung in a counterclockwise direction on the fixed shaft 374 serving as a fulcrum, and the projection 378 is retreated from the receiving hole 372 (see FIG. 22).

Due to demagnetization of the first solenoid 302, the engaging member 258 is swung in a counterclockwise direction in FIG. 9 by the spring 274, and the hook 268 resiliently engages the engaging rib 264. In other words, the circular projection 262, namely, the shutter plate 254 becomes incapable of swinging in a clockwise direction and capable of swinging in a counterclockwise direction in FIG. 20.

In this state, since the shutter plate 254 is positioned at the opening position OP of the outlet opening 252, the second portion to be moved 418 of the swing lever 412 is released from the cam 419, so that the engaging pin 404 is caused to enter the fitting hole 402 from the coin replenishing safe 220 by the fifth spring 408 (see FIG. 21). In other words, the coin replenishing safe 220 cannot be detached from the coin receiving and dispensing machine 100 in this state.

Next, at step S13, the outlet opening 252 is closed by moving the shutter plate 254 to the closing position CP by rotating the handle 316 manually in a counterclockwise direction in FIG. 16. Thereby, the cam 419 is caused to face the swing lever 412, so that the second portion to be moved 418 of the swing lever 412 is swung in a clockwise direction by the cam 419. The engaging pin 404, link-coupled to the swing lever 412, is pulled into the coin replenishing safe 220 (see FIG. 13), and disengages from the fitting hole 402.

Next, at step S14, the coin replenishing safe 220 is moved to the side of the front face 131F. Since the piece to be moved 396 is released from the bottom face of the coin replenishing safe 220, the micro switch 398 is turned OFF, and outputs an anti-attachment signal AAS. At this time the receiving hole 372 is positioned to face the projection 378. Thereby, the coin replenishing safe 220 can be detached from the mounting recessed portion 133.

Next, according to the determination about the status of the anti-attachment signal AAS from the micro switch 398 at step S15, the processing proceeds to step S16. After a predetermined period of time, the second solenoid 386 is turned OFF at step S16, and the processing is terminated. Next, the receiving port cover 120 is folded frontward and the magnets 136L and 136R attract the iron pieces 137L and 137R, respectively, so that the front end of the receiving port cover 120 is flush with the front face 131F of the main body 131, thereby the replenishing work is terminated.

Figure 23:
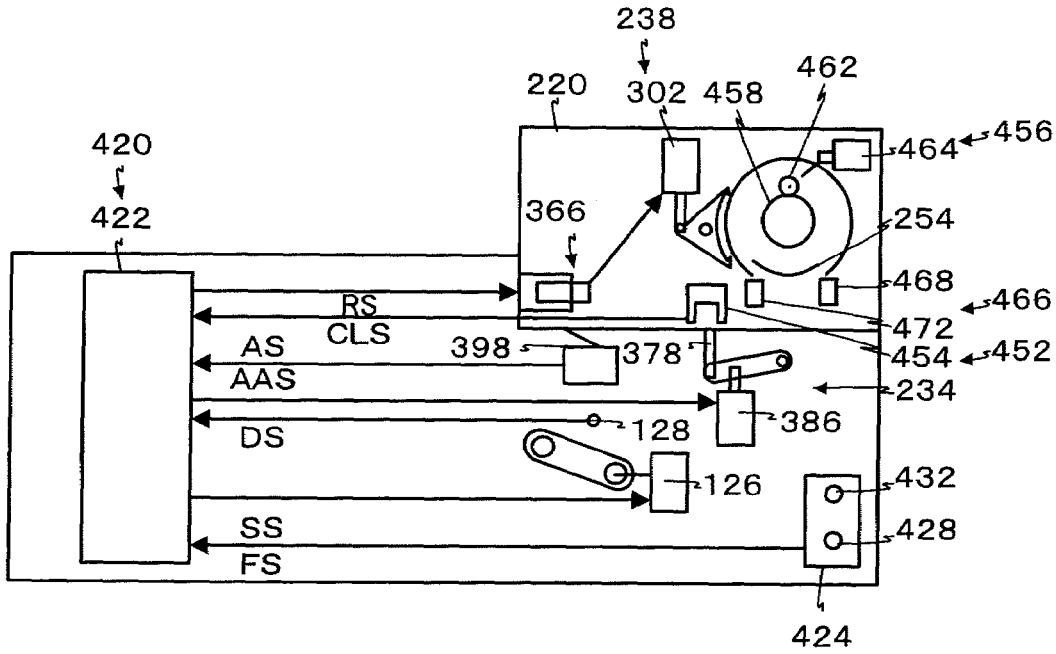
FIG. 23 is a schematic block diagram of a coin replenishing apparatus of a second embodiment of the present invention.
Figure 24:
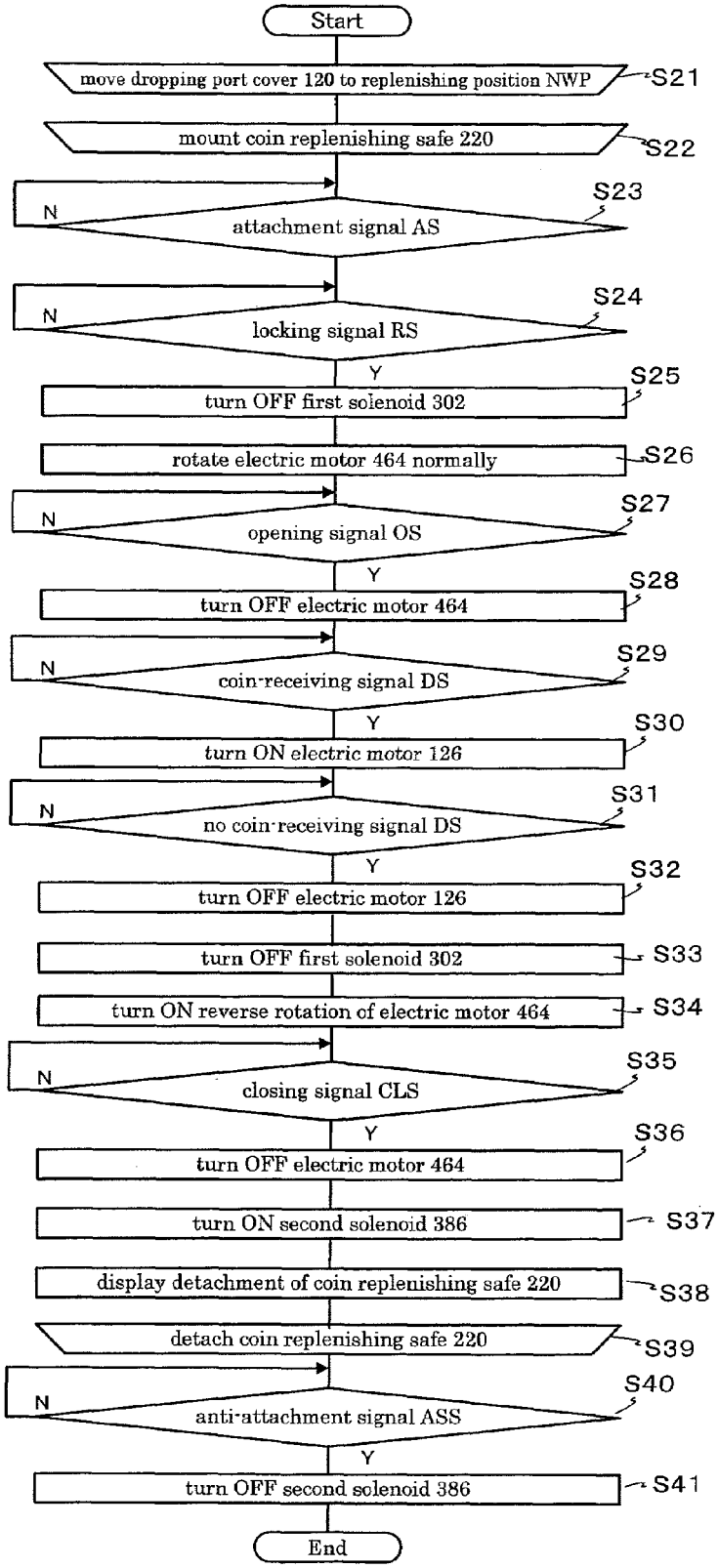
FIG. 24 is a flowchart of the coin replenishing apparatus of the second embodiment of the present invention.

A second embodiment is an example of automating the manual work in the first embodiment. FIG. 23 is a schematic block diagram of a coin replenishing apparatus of a coin receiving and dispensing machine of the second embodiment of the present invention. FIG. 24 is a flowchart for explanation of an operation of the coin replenishing apparatus of the coin receiving and dispensing machine of the second embodiment of the present invention.

The same portions as the first embodiment are defined with the same reference numerals, and only the different elements of the configuration of the second embodiment will be explained. A photoelectronic sensor 454 serving as a main-body-locking detecting apparatus 452 of the main body locking apparatus 234 is attached to the coin replenishing safe 220. The photoelectronic sensor 454 detects when the coin replenishing safe 220 is locked on the main body 131 due to the projection 378 blocking the path of the optical axis when the projection 378 projects into the receiving hole 372 of the coin replenishing safe 220.

A movement apparatus 456 for the shutter plate 254 is provided in the coin replenishing safe 220. The movement apparatus 456 has a function of moving the shutter plate 254 automatically from the closing position CP to the opening position OP and from the opening position OP to the closing position CP.

In the second embodiment, the movement apparatus 456 includes a gear 458 formed on the peripheral face of the handle 316, a pinion gear 462 meshed with the gear 458, and an electric motor 464 rotating the pinion gear 462. The movement apparatus 456 is disposed in the safe casing 240, including the handle 316 and because of this built-in feature, any unauthorized access can further be prevented.

Further, an opening-and-closing checking apparatus 466 for the shutter plate 254 is also provided in the coin replenishing safe 220. The opening-and-closing checking apparatus 466 has a function of detecting when the shutter 228 is input to a state of opening and a state of closing.

The opening-and-closing checking apparatus 466 includes an opening position sensor 468 and a closing position sensor 472 disposed at the left and right end portions of the outlet opening 252, and it can detect when the shutter plate 254 is positioned at the opening position OP when the opening position sensor 468 and the closing position sensor 472 do not detect the shutter plate 254 and also detects when the shutter plate 254 is positioned at the closing position CP when the opening position sensor 468 and the closing position sensor 472 detect the shutter plate 254.

The main-body-locking detecting apparatus 452, the opening-and-closing checking apparatus 466, and the movement apparatus 456 are connected to the main body control apparatus 420 via the connector 366. The main-body-locking detecting apparatus 452 and the opening-and-closing checking apparatus 466 output signals to the main body control apparatus 420, and the drive of the movement apparatus 456 is controlled by the main body control apparatus 420.

Next, an operation of the second embodiment will be explained with reference to the flowchart in FIG. 24.

First, similarly to the first embodiment, the dropping port cover 120 is pivoted and moved to the replenishing position SP at step S21. Next, at step S22, the coin replenishing safe 220 is attached to the attachment apparatus 241.

When the piece 396 to be moved is pushed by the bottom face of the coin replenishing safe 220 and the micro switch 398 outputs the mounting signal AS at step S23, the processing proceeds to step S24. In this state, the projection 378 of the swing lever 376 is projecting into the receiving hole 372 of the coin replenishing safe 220. Thereby, the optical axis is cut by the projection 378, so that the photoelectronic sensor 454 of the main-body-locking detecting apparatus 452 outputs a locking signal RS. When the locking signal RS is identified at step S24, the processing proceeds to step S25, and after the first solenoid 302 is excited, the processing proceeds to step S26.

Similarly to the first embodiment, when the first solenoid 302 is excited, the engaging member 258 is swung in a clockwise direction in FIG. 9, so that the hook 268 releases from the engaging rib 264, and the return blocking hook 282 engages the engaging rib 264.

The electric motor 464 is driven to rotate normally at step S26, and the processing proceeds to step S27. According to the normal rotation of the electric motor 464, the gear 458 formed on the outer peripheral face of the handle 316 is swung in a clockwise direction in FIG. 16 via the pinion gear 462. Thereby, the shutter plate 254 is moved in a rotating manner via the torque limiter 318 to open the outlet opening 252.

Similarly to the first embodiment, in the opening state of the outlet opening 252, since the cam 419 does not face the movable portion 418 of the swing lever 412, the swing lever 418 is swung in a counterclockwise direction in FIG. 21 by the fifth spring 408, and the engaging pin 404 link-coupled projects outside the coin replenishing safe 220, and projects into the fitting hole 402. Thereby, the coin replenishing safe 220 is mechanically locked when the outlet opening 252 is opened, and cannot be detached from the main body 131.

When the shutter plate 254 completely opens the outlet opening 252, both the closing position sensor 472 and the opening position sensor 468 terminates any detecting of the shutter plate 254, so that an opening signal OS is outputted. When the opening signal OS is identified at step S27, the processing proceeds to step S28.

When the shutter plate 254 swings according to rotation of the electric motor 464, and is blocked from rotating due to the left end 265L of the arc-shaped long hole 265, even if the gear 458 is further rotated in the same direction, only the gear 458 idly rotates due to the torque limiter 318, so that the shutter plate 254 or the like is difficult to be broken.

The rotary drive of the electric motor 464 is stopped at step S28, and the processing proceeds to step S29. Due to the stopping of the electric motor 464, the shutter plate 254 is held at the opening position OP and the outlet opening 252 is fully opened. Thereby, any coins in the safe chamber 248 are dropped onto the flat belt 130 via the coin dropping hole 138.

Since the optical axis of the photo-electronic sensor 150 is blocked by the replenishment coins, the coin-reception detecting signal DS is outputted at step S29, and the processing proceeds to step S30. After the electric motor 126 of the coin receiving apparatus 102 is rotated at step S30, the processing proceeds to step S31. According to the rotation of the electric motor 126, the coins on the flat belt 130 is caused to pass below the reverse roller 124, from the downstream end portion of the coin-receiving flat belt 130, and are dropped into the retaining bowl 174 of the separating and delivering apparatus 104 while being guided by the guide chute 436, similarly to the first embodiment.

The authenticity and kinds of coins separated in a one by one manner by the separating and delivering apparatus 104 are also identified by the coin-kind identifying apparatus 106 similarly to the first embodiment, advanced in the sorting apparatus 110, dropped into predetermined sorting holes, and retained in the coin hoppers 210. When all the coins in the safe chamber 248 are dropped onto the flat belt 130, and all the coins are delivered to the next step, the coin sensor 128 will not detect a coin, so that the photoelectronic sensor 150 does not output the coin-reception detecting signal DS for a predetermined period of time. When the coin sensor 128 has stopped detecting the coin-reception detecting signal DS for a predetermined period of time at step S31, the processing proceeds to step S32.

After the electric motor 126 is stopped at step S32, the processing proceeds to step S33. Due to the stop of the motor 126, the advance of the flat belt 130 is stopped. After the first solenoid 302 turns OFF at step S33, the processing proceeds to step S34.

Due to demagnetization of the solenoid 302, similarly to the first embodiment, the circular projection 262, namely, the shutter plate 254 becomes incapable of swinging in a clockwise direction and capable of rotating only in a counterclockwise direction in FIG. 20.

The electric motor 464 is reversed at step S34, and the processing proceeds to step S35. Due to the reverse of the electric motor 464, the gear 458 is reversed, so that the shutter plate 254 is swung in the closing direction and the outlet opening 252 is closed. According to the rotation of the shutter plate 254, the cam 419 faces the second portion to be moved 418 of the swing lever 412, so that the swing lever 412 is swung in the clockwise direction by the cam 419. Thereby, the engaging pin 404 link-coupled to the swing lever 412 is pulled into the coin replenishing safe 220 (see FIG. 13), and pulled out of the fitting hole 402.

When the opening position sensor 468 and the closing position sensor 472 detect the shutter plate 254 at step S35, a closing signal CLS is outputted, and the processing proceeds to step S36. After the electric motor 464 turns OFF at step S36, the processing proceeds to step S37. After the second solenoid 386 turns on at step S37, the processing proceeds to step S38.

Figure 22:
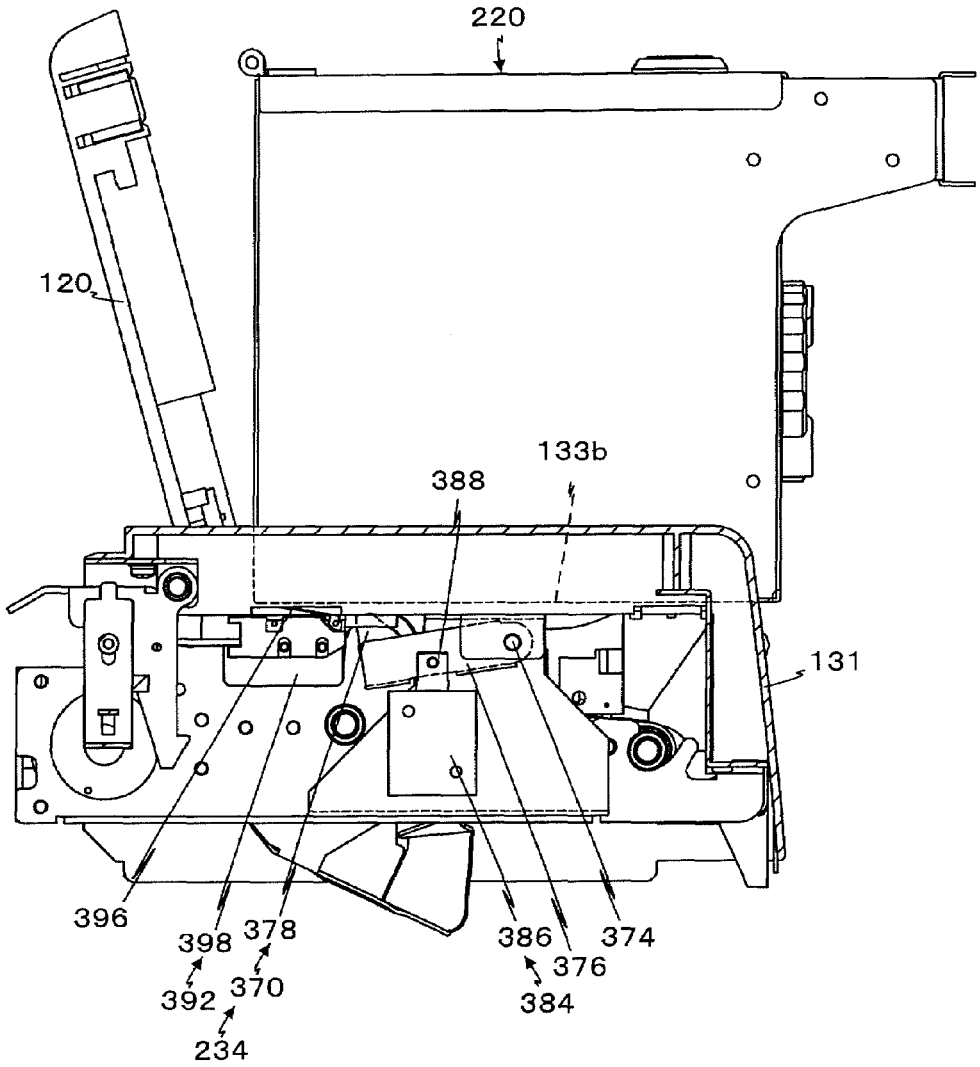
FIG. 22 is a sectional view of the state in which the main body locking mechanism is unlocked in the state in which the coin replenishing safe of the first embodiment of the present invention is mounted on the coin receiving and dispensing machine.

Due to excitation of the solenoid 386, the projection 378 retreats from the receiving hole 372 (see FIG. 22). At step S38, an indication which prompts detachment of the coin replenishing safe 220 is displayed on a liquid crystal display panel of the operating panel 424, and the processing proceeds to step S39. At step S39, the worker moves the coin replenishing safe 220 to the side of the front face 131F.

At this time, since the projection 378 has been retreated from the receiving hole 372, the coin replenishing safe 220 can be detached from the coin receiving and dispensing machine 100. In this course, the micro switch 398 turns OFF to output an anti-attachment signal AAS of the coin replenishing safe 220.

Next, when determination about the anti-attachment signal AAS from the micro switch 398 is made at step S40, the processing proceeds to step S41. After the second solenoid 386 turns OFF after a predetermined period of time at step S41, the processing is terminated.

Next, the receiving port cover 120 is folded frontward and the magnets 136L and 136R attract the iron pieces 137L and 137R, respectively, so that the front end of the receiving cover 120 becomes flush with the front face 131F of the main body 131, thereby the replenishing work is terminated.

In the second embodiment, since the operation for opening and closing the outlet opening 252 can be performed automatically, there is an advantage that the replenishing work can be performed more easily. Further, owing to the main-body-locking detecting apparatus 452, since the shutter plate 254 cannot be moved unless the fact that the projection 378 exists in the receiving hole 372 is detected, it is possible not to mount the apparatus 400 for preventing the shutter 228 from being left open.

Those skilled in the art will appreciate that various adaptations and modifications of the just-described preferred embodiment can be configured without departing from the scope and spirit of the invention. Therefore, it is to be understood that, within the scope of the amended claims, the invention may be practiced other than as specifically described herein.

What is claimed is:

1. A coin replenishing apparatus for a coin receiving and dispensing machine, comprising:

a coin replenishing safe for providing a supply of coins;

a coin receiving and dispensing machine having a coin input port, which can sort the coins and retain the coins in a retaining apparatus separately according to the kinds of coins, and can dispense a predetermined number of coins based upon a dispensing command, wherein the coin replenishing safe includes a safe chamber, a replenishing door with a locking apparatus capable of opening and closing an outlet opening positioned on a side of the safe chamber and a replenishing hole of the safe chamber, a shutter mounted in the coin replenishing safe, capable of rotating for closing the outlet opening, a shutter locking unit for the shutter, a rotating unit for the shutter, and an unlocking unit for the shutter locking unit, and the coin receiving and dispensing machine includes an attachment apparatus for attaching the coin replenishing safe on the coin receiving and dispensing machine in a state of placing the outlet opening on the coin input port and a main body locking unit on the coin receiving and dispensing machine for attachment to the coin replenishing safe.

2. The coin replenishing apparatus of the coin receiving and dispensing machine according to claim 1, comprising a stopper for blocking the shutter from rotating in a direction opposite to an opening direction of the outlet opening at a time of rotating in the opening direction of the outlet opening.

3. The coin replenishing apparatus of the coin receiving and dispensing machine according to claim 1, comprising an operation handle joined to the shutter with a drive joining unit and exposed on the outside of the coin replenishing safe for operation by a user.

4. The coin replenishing apparatus of the coin receiving and dispensing machine according to claim 3, wherein a torque limiter is disposed in the drive joining unit between the shutter and the operating handle.

5. A coin replenishing apparatus for a coin receiving and dispensing machine, comprising;

a coin replenishing safe for the coin receiving and dispensing machine which conveying coins put onto a belt disposed below a coin input port, sorts the coins and retains the coins in a retaining apparatus separately according to kinds of the coins, and can dispense a predetermined number of coins, based upon a dispensing command, retaining apparatus corresponding to the kinds of coins, wherein the coin replenishing safe includes a safe chamber, a replenishing door with a locking apparatus capable of opening and closing an outlet opening positioned on the downside of a safe chamber and a replenishing hole for the safe chamber;

a lateral circular coin retaining portion is formed in the coin replenishing apparatus;

a replenishing port opens at an upper end portion of the coin retaining portion;

a replenishing lid can lock to the coin replenishing safe by a locking unit to cover the replenishing port;

an outlet opening is provided at a lower end portion of the coin retaining portion;

a shutter is mounted in the coin retaining portion, and is capable of rotating about a transverse axis, for opening and closing the outlet opening;

shutter locking unit for the shutter;

rotating unit for the shutter; and unlocking unit for the shutter locking unit, and the coin receiving and dispensing machine includes an attaching unit for attaching the coin replenishing safe on the coin receiving and dispensing machine in a state of placing the outlet opening on the coin input port with a main body locking unit for attaching the coin replenishing safe on the coin receiving and dispensing machine.

6. The coin replenishing apparatus of claim 5, wherein the shutter includes circular side plates interconnected with a curved shutter plate connected to only a portion of each circular side plate.

7. The coin replenishing apparatus of claim 6 wherein the rotating unit for the shutter includes a rotable handle on an exterior of one of the circular side plates.

8. The coin replenishing apparatus of claim 7 further including a torque limiter unit, connected to the rotable handle, to limit the amount of torque that can be applied to the rotable handle.

9. The coin replenishing apparatus of claim 5 wherein the rotating unit for the shutter includes a rotable gear and a motor to activate the rotable gear for moving the shutter.

10. The coin replenishing apparatus of claim 5 wherein the shutter locking unit includes a locking member and a solenoid for activating the locking member, the locking member and the solenoid are contained within the safe chamber.

11. The coin replenishing apparatus of claim 5 wherein the attaching unit includes a pair of side recessed grooves provided on the sides of the safe and configured to receive locking rail members.

* * * * *